US006897845B2

(12) United States Patent
Ozawa

(10) Patent No.: US 6,897,845 B2
(45) Date of Patent: May 24, 2005

(54) LIQUID CRYSTAL DISPLAY DEVICE, DRIVING CIRCUIT, DRIVING METHOD, AND ELECTRONIC DEVICES

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 346 days.

(21) Appl. No.: 10/004,822

(22) Filed: Dec. 7, 2001

(65) Prior Publication Data

US 2002/0084969 A1 Jul. 4, 2002

(30) Foreign Application Priority Data

Dec. 22, 2000 (JP) ..... 2000-390418

(51) Int. Cl.[7] ..... G09G 3/36; G09G 5/00; G09G 5/10

(52) U.S. Cl. ..... 345/94; 345/89; 345/92; 345/100; 345/211; 345/690; 345/96; 345/209

(58) Field of Search ..... 345/87, 90, 94, 345/96, 98–100, 211, 204, 690, 691

(56) References Cited

U.S. PATENT DOCUMENTS 5,657,039 A * 8/1997 Mizukata et al. ..... 345/95
5,666,133 A * 9/1997 Matsuo et al. ..... 345/100
5,706,023 A * 1/1998 Nagata et al. ..... 345/92

FOREIGN PATENT DOCUMENTS

| | | |
|---|---|---|
| JP | A-2-913 | 1/1990 |
| JP | A-4-145490 | 5/1992 |
| JP | B2-2568659 | 10/1996 |

* cited by examiner

*Primary Examiner*—Regina Liang
*Assistant Examiner*—Duc Q Dinh
(74) *Attorney, Agent, or Firm*—Oliff & Berridge, PLC

(57) ABSTRACT

The voltage swing of a data signal, which is supplied to a data line, is maintained to be small, thereby reducing the power consumption. When a scanning signal supplied to a scanning line is set to an on-voltage, a data signal with a voltage, depending on the density and depending on the writing polarity, is applied to a data line. In this case, a TFT is turned on. Thus, a liquid crystal capacitor and storage capacitor store the charge corresponding to the voltage of the data signal. Then, the scanning signal is set to an off-voltage to turn the TFT off, and the voltage of the other terminal of the storage capacitor is raised from the low-level of capacitor voltage to the high-level, and the charge corresponding to the raised voltage amount is redistributed to the liquid crystal capacitor. Thus, the effective voltage value applied to the liquid crystal capacitor can correspond to the voltage swing of the data signal or more.

11 Claims, 16 Drawing Sheets

LIQUID CRYSTAL DISPLAY DEVICE, DRIVING CIRCUIT, DRIVING METHOD, AND ELECTRONIC DEVICES

BACKGROUND OF THE INVENTION

1. Field of Invention

The present invention relates to a liquid crystal display device designed to reduce power consumption, to a driving circuit, to a driving method, and to electronic devices.

2. Description of Related Art

In recent years, liquid crystal display devices (LCD) have been widely used for various information processing devices, flat-screen TVs, and other apparatus as display devices to replace cathode ray tubes (CRT).

These liquid crystal display devices can be classified into various types depending on the driving method and other features. An active-matrix-type LCD device, in which pixels are driven by switching elements, is arranged as follows. Specifically, an active-matrix-type LCD device includes pixel electrodes arranged in a matrix, an element substrate provided with switching elements connected to each of the pixel electrodes, a counter substrate on which counter electrodes are formed to face the pixel electrodes, and liquid crystal sandwiched between these substrates.

In this arrangement, when an on-voltage is applied to a scanning line, the switching element connected to the scanning line becomes conductive. In the conductive state, if the voltage signal corresponding to a gray scale (density) is applied to an element electrode via a data line, the charge corresponding to the voltage signal is stored in a liquid crystal capacitor for the liquid crystals sandwiched between the pixel electrode and the counter electrode. After the charge is stored, even if an off-voltage is applied to the scanning line to make the switching element nonconductive, the charge stored in the liquid crystal capacitor is maintained by the capacitance of the liquid crystal capacitor itself, and the accompanying storage capacitor. In this way, by driving each switching element and controlling the amount of charge to be stored according to the gray scale, the orientation of the liquid crystal changes. Thus, the gray level is changed for every pixel, thereby making it possible to perform gray-scale display.

Low power consumption is a favorable feature for liquid crystal devices because of the characteristics, features, and applications of the electronic devices that incorporate liquid crystal devices. At the same time, in order to drive a liquid crystal capacitor, a high voltage swing, such as 10 volts or more, for example, is required. Thus the voltage signal applied to a data line is required to have a similar voltage swing.

SUMMARY OF THE INVENTION

However, within a liquid crystal display device, the data line is driven with the highest frequency. Thus, in an arrangement in which the data line is supplied with a voltage signal having a large swing and with a high frequency, the power consumption increases, which is contrary to lowering the power consumption.

Accordingly, the present invention is made in view of the foregoing, and an object of the invention is to maintain the voltage swing of the voltage signal applied to a data line to be small, thereby providing a liquid crystal device, a driving circuit, a driving method, and electronic devices which are intended to reduce power consumption.

In order to accomplish the above-described object, in a liquid crystal device according to a first aspect of the present invention, a liquid crystal device is provided that includes:

a scanning line which becomes an on-voltage at every predetermined interval; a liquid crystal capacitor having a liquid crystal sandwiched between a counter electrode and a pixel electrode; a data line which has a voltage difference corresponding to a density on the basis of the voltage of the counter electrode and to a writing polarity of the liquid crystal capacitor when the scanning line is the on-voltage; a first switching element inserted between the data line and the pixel electrode, the first switching element being turned on when the on-voltage is applied to the scanning line, and being turned off when an off-voltage is applied; and a storage capacitor having one terminal connected to the pixel electrode. When the voltage of the data line corresponds to a positive-polarity writing during the period when the other terminal is the on-voltage, the voltage of the other terminal is shifted to high after the scanning line turns off, and when the voltage of the data line corresponds to a negative-polarity writing during the period when the other terminal is the on-voltage, the voltage of the other terminal is shifted to low after the scanning line turns off.

With this arrangement, when on-voltage is applied to the scanning line, the first switching element connected to the scanning line is turned on, thereby the charge corresponding to the applied voltage to the data line is stored to the liquid crystal capacitor and storage electrode. When the first switching element is turned off thereafter, the voltage of the other terminal of the storage capacitor shifts, and the voltage of one terminal of storage capacitor is raised by that amount (or lowered). At the same time, the amount of charge raised (or lowered) is distributed to the liquid crystal capacitor. Thus, the voltage effective value that is correspondingly more than the applied voltage to the data line is applied to the liquid crystal capacitor. In other words, when compared with the voltage swing applied to the pixel electrode, the voltage swing of the voltage signal applied to the data line is maintained at a small value. Thus, it is possible to drive the data line with a low voltage to reduce the power consumption.

At the same time, in the first aspect of the present invention, if the storage capacitor is much larger than the liquid crystal capacitor, the shifted amount of the other terminal of the storage capacitor can be assumed to be applied to the liquid crystal capacitor. However, in practice, there is a limit that the storage capacitor can only be less than a several-fold amount of the liquid crystal capacitor. Thus, the voltage shift amount of the other terminal of the storage capacitor is compressed and applied to the liquid crystal capacitor. If the ratio of the capacitance of the storage capacitor to the liquid crystal capacitor is 4 or more, the decrease in amount of the voltage swing is as little as less than 20%, which is realistic from a layout point of view.

Also, in the first aspect of the present invention, it is preferable that the other terminal of the storage capacitor is connected to each line in common via a capacitor line. In this arrangement, the liquid crystal capacitor can only be inverted for every scanning line (row inversion) or for every vertical scanning period (frame inversion). Thus, it is preferable to divide the capacitor line, and the voltage shift directions of the divided capacitor lines are contrary to each other. With the arrangement, the writing polarity of the liquid crystal capacitor is inverted at the boundary which is the divided part of the capacitor line. Thus, an entering current to the counter electrode is deceased as compared with the inversion of every scanning line, thereby making it possible to reduce the power consumption.

At the same time, in the first aspect of the present invention, it is preferable to further include: a low-level capacitor line which is maintained at a predetermined first voltage; a high-level capacitor line which is maintained at a second voltage that is higher than said first voltage; and a selector which selects either one of said low-level capacitor line and said high-level capacitor line depending on the voltage of a selection signal line, and applies the voltage to the other terminal of said storage capacitor. With this arrangement, it is possible to select a writing polarity for each electrode.

In this arrangement, it is preferable for the selector to include: a second switching element inserted between one of said low-level capacitor line and said high-level capacitor line, and the other terminal of said storage capacitor, and the second switching element turns on when the voltage of said selection signal line is one of the high-level and low-level; and a third switching element inserted between the other one of said low-level capacitor line and said high-level capacitor line, and the other terminal of said storage capacitor, and the third switching element turns on when the voltage of said selection signal line is the other one of the high-level and low-level. With this feature, the first, second, and third switching elements can be formed in a common process. Thus, this arrangement is advantageous for reducing power consumption, miniaturization and integration.

Also, in the arrangement having a selector, it is preferable that the selector have an opposite selection characteristic to the selection characteristic of an adjacent selector in the extending direction of the scanning line. With this feature, the liquid crystal capacitor can be inverted for each data line (column inversion), thereby making it possible to achieve a high-quality screen.

Further, in the arrangement having a selector, it is most preferable that the selector have an opposite selection characteristic to the selection characteristic of an adjacent selector in the extending direction of the scanning line, and also have an opposite selection characteristic to the selection characteristic of an adjacent selector in the extending direction of the data line. With this feature, the liquid crystal capacitor can be inverted for each pixel, thereby making it possible to achieve high-quality screen.

Also, the electronic devices according to the present invention are equipped with the above-described liquid crystal display devices, thereby making it possible to reduce power consumption. In this regard, these devices include projectors for extended projection of images, and direct-viewing type displays, for example, display units of personal computers, mobile phones, and any other current or later developed electronic devices that are capable of incorporating the liquid crystal display devices.

In this regard, the first aspect described above can be accomplished as a driving circuit for a liquid crystal display device. Specifically, a driving circuit for a liquid crystal display device according to a second aspect of the present invention can be provided such that the display device includes: a liquid crystal capacitor arranged at the intersection of a scanning line and a data line, a liquid crystal being sandwiched between a counter electrode and pixel electrode; a first switching element inserted between the data line and the pixel electrode, the first switching element being turned on when the on-voltage is applied to the scanning line, and being turned off when an off-voltage is applied; and a capacitor of which one terminal is connected to the pixel electrode. The driving circuit includes: a scanning line driving circuit which turns the scanning line an on-voltage at every predetermined interval; a data line driving circuit which turns the voltage of the data line to a voltage difference corresponding to a density on the basis of the voltage of the counter electrode and to a writing polarity of the liquid crystal capacitor when the scanning line is on-voltage; and a storage capacitor driving circuit. When the voltage of the data line corresponds to a positive-polarity writing during the period when the scanning line is the on-voltage, the voltage of the other terminal of the storage capacitor is shifted to high after the scanning line turns off, and when the voltage of the data line corresponds to a negative-polarity writing during the period when the scanning line is on-voltage, the voltage of the other terminal is shifted to low after the scanning line turns off. With this arrangement, in the same manner as the first aspect of the present invention, compared with the voltage swing applied to the pixel electrode, the voltage swing of the voltage signal applied to the data line can be maintained to be small, thereby making it possible to reduce power consumption.

Additionally, the first aspect described above can be accomplished as a driving method for a liquid crystal display device. Specifically, a driving method for a liquid crystal display device according to a third aspect of the present invention can be provided such that the display device includes: a liquid crystal capacitor arranged at the intersection of a scanning line and a data line, a liquid crystal being sandwiched between a counter electrode and pixel electrode; a first switching element inserted between the data line and the pixel electrode, the first switching element being turned on when the on-voltage is-applied to the scanning line, and being turned off when an off-voltage is applied to the scanning line; and a capacitor of which one terminal is connected to the pixel electrode. The driving method includes: turning a scanning line an on-voltage at every predetermined interval; turning a voltage of the data line to a voltage difference corresponding to a density on the basis of the voltage of the counter electrode and to a writing polarity of the liquid crystal capacitor when the scanning line is the on-voltage; and shifting the voltage of the other terminal of the storage capacitor to high after the scanning line turns off when the data line corresponds to a positive-polarity writing during the period when the scanning line is the on-voltage, and shifting the voltage of the other terminal of the storage capacitor to low after the scanning line turns off when the data line corresponds to a negative-polarity writing during the period when the scanning line is the on-voltage. With this arrangement, in the same manner as the first and second aspect of the present invention, compared with the voltage swing finally applied to the pixel electrode, the voltage swing of the voltage signal applied to the data line can be maintained to be small, thereby making it possible to reduce power consumption.

DETAILED DESCRIPTION OF PREFERRED EMBODIMENTS

In the following, embodiments of the present invention will be further illustrated with reference to the accompanying drawings.

<1: First Embodiment>

Figure 1:
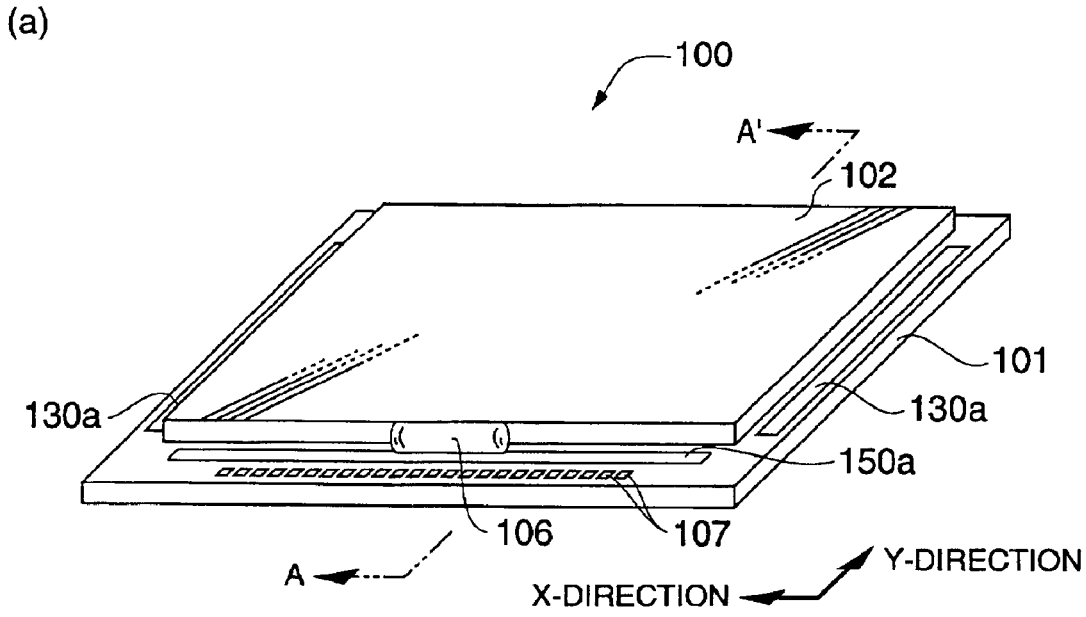
FIG. 1(*a*) is a perspective view showing the external structure of a liquid crystal display device according to a first embodiment of the present invention, and FIG. 1(*b*) is a cross-sectional view taken along plane A–A' of FIG. 1(*a*)
Figure 1:
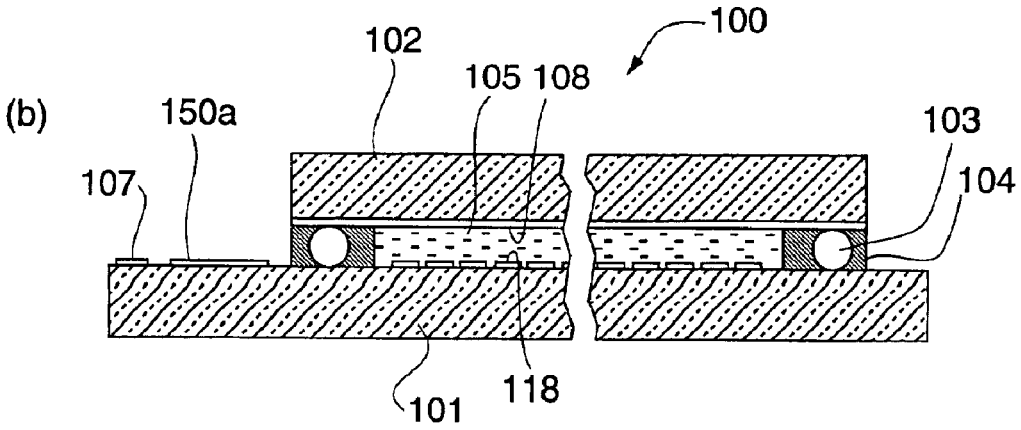

First, a liquid crystal display device according to a first embodiment of the present invention is described. FIG. 1(*a*) is a perspective view showing the structure of the liquid crystal display device, and FIG. 1(*b*) is a cross-sectional view taken along plane A–A' of FIG. 1(*a*).

As shown in FIGS. 1(*a*) and 1(*b*), the liquid crystal display device 100 is formed with an element substrate 101 over which various elements and pixel electrodes 118 are arranged, and a counter substrate 102 under which counter electrodes 108 and other elements are arranged. The electrodes are bonded together via a spacer 103 and sealing material 104, while keeping a certain gap between the two with their electrode formed faces facing each other. In the gap, for example, a TN (Twisted Nematic) type liquid crystal 105 is enclosed.

In this embodiment, the element substrate 101 can be formed of glass, semiconductor, quartz, and any other suitable element, but can also be formed of an opaque substrate. However, if the element substrate 101 is formed of an opaque substrate, the display device needs to be of a reflection type, not a transmission type. Also, a sealing material 104 is formed along the outer periphery of the counter substrate 102, and has an opening to enclose the liquid crystal 105. Accordingly, the opening is sealed by the sealing material 106 after enclosing the liquid crystal 105.

Next, on the opposing surface of the element substrate 101, in the area 150*a* located along an outer edge of the sealing material 104, a circuit that drives the data line is formed (details will be described in the following). And at the outer edge, a plurality of package terminals 107 are formed to which various signals are input from external circuits.

Also, in the area 130*a* located adjacent to this edge, circuits that drive scanning lines and capacitor lines are formed (details will be described in the following) to drive from both sides in the row (X) direction. Also, on the remaining edge, wiring lines (not shown in the FIGS. 1(*a*) and 1(*b*)), which are shared by the circuits formed in the two areas 130*a*, are arranged. In this regard, if the delay of the signal supplied in the row direction is not a problem, the circuit which outputs these signals may be placed on only one area 130*a*.

At the same time, the counter electrodes 108 arranged on the counter substrate 102 are electrically connected using conductive material, such as silver paste, to the package terminal 107 formed on the element substrate 101 in at least one place out of the four corners of parts laminated with the element substrate 101, and are formed such that a constant voltage $LC_{com}$ is always applied.

In addition, over the counter substrate 102, a color filter can be disposed in the area facing the pixel electrodes 118 as necessary, although this feature is not particularly shown in FIGS. 1(*a*) and 1(*b*). However, when used as alight modulator, such as in a projector described below, it is not necessary to form a color filter on the counter substrate 102. Also, whether a color filter is formed or not, in order to prevent deterioration of the contrast ratio caused by leaking light, a light blocking filter is disposed in the portion of the area not facing the pixel electrodes 118 (not shown in the FIGS. 1(*a*) and 1(*b*)).

Also, on each surface of the element substrate 101 and the counter substrate 102, an orientation film processed by rubbing is disposed in such a manner that the longitudinal directions of molecules in the liquid crystal 105 are successively twisted at about 90 degrees between both of the substrates, whereas on each of the back sides, a light polarizer is disposed such that the absorption axis is along the orientation direction. As a result, if the effective voltage applied to the liquid crystal capacitor (capacitor of the liquid crystal 105 sandwiched between a pixel electrode 118 and counter electrode 108) is zero, the transmission becomes a maximum, whereas as the effective voltage increases, the transmission gradually decreases, and finally becomes a minimum. Thus, the liquid crystal display device according to the present embodiment is formed in the normally white mode.

In this regard, the orientation film and light polarizer are not directly related to the present embodiment, so that their illustration in FIGS. 1(*a*) and 1(*b*) is omitted. Also, in FIG. 1(*b*), the counter electrode 108, pixel electrodes 118, and package terminals 107 are shown to have a thickness. However, this is for the sake of convenience to show the positional relationship of the elements, and in practice they are so thin as to be invisible to a user's naked eye compared to the substrate.

<1-1: Electrical Structure>

Figure 2:
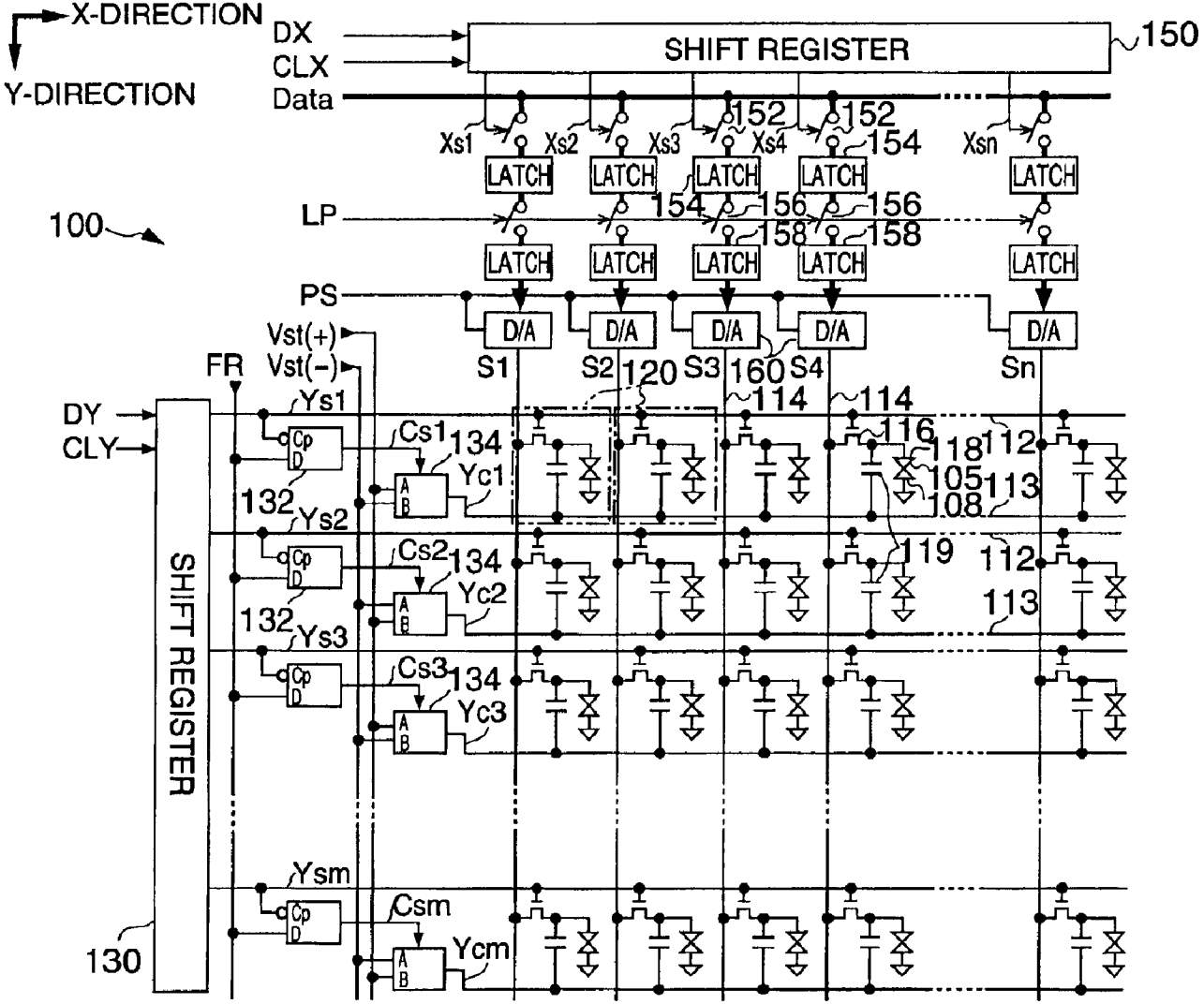
FIG. 2 is a schematic showing the electrical structure of the liquid crystal display device.

In the following description, the electrical structure of the liquid crystal display device according to the present embodiment will be described. FIG. 2 is a schematic showing the electrical structure.

As shown in FIG. 2, scanning lines 112 and capacitor lines 113 are formed to extend in the X (row) direction, data lines 114 are formed to extend in the Y (column) direction, and pixels 120 are formed at their intersections. Here, for the sake of explanation, given that the number of the scanning lines 112 (capacitor lines 113) is "m" and the number of the data lines 114 is "n", the pixels 120 are arranged in a matrix with m rows and n columns. Also, in the present embodiment, m and n are shown as even numbers in FIG. 2, but they are not limited in this manner.

Next, when turning attention to one electrode 120, the gate of an N-channel-type Thin Film Transistor (hereinafter, referred to as "TFT") 116 is connected to the scanning line 112, the source is connected to the data line 114, and the drain is connected to one end of pixel electrode 118 and storage capacitor 119. As described above, the pixel electrode 118 faces the counter , electrode 108, and the liquid crystal 105 is sandwiched between both electrodes. Thus, the liquid crystal capacitor is formed sandwiching the liquid crystal 105 with one end thereof formed as the pixel electrode 118, and the other end as the counter electrode 108.

With this arrangement, when the scanning signal supplied to the scanning line 112 becomes H, TFT 116 is turned on, and the charge corresponding to the voltage of the data line 114 is written into the liquid crystal capacitor and the storage capacitor 119. In this regard, the other end of the storage capacitor 119 is commonly connected to every row of the capacitor line 113.

Figure 3:
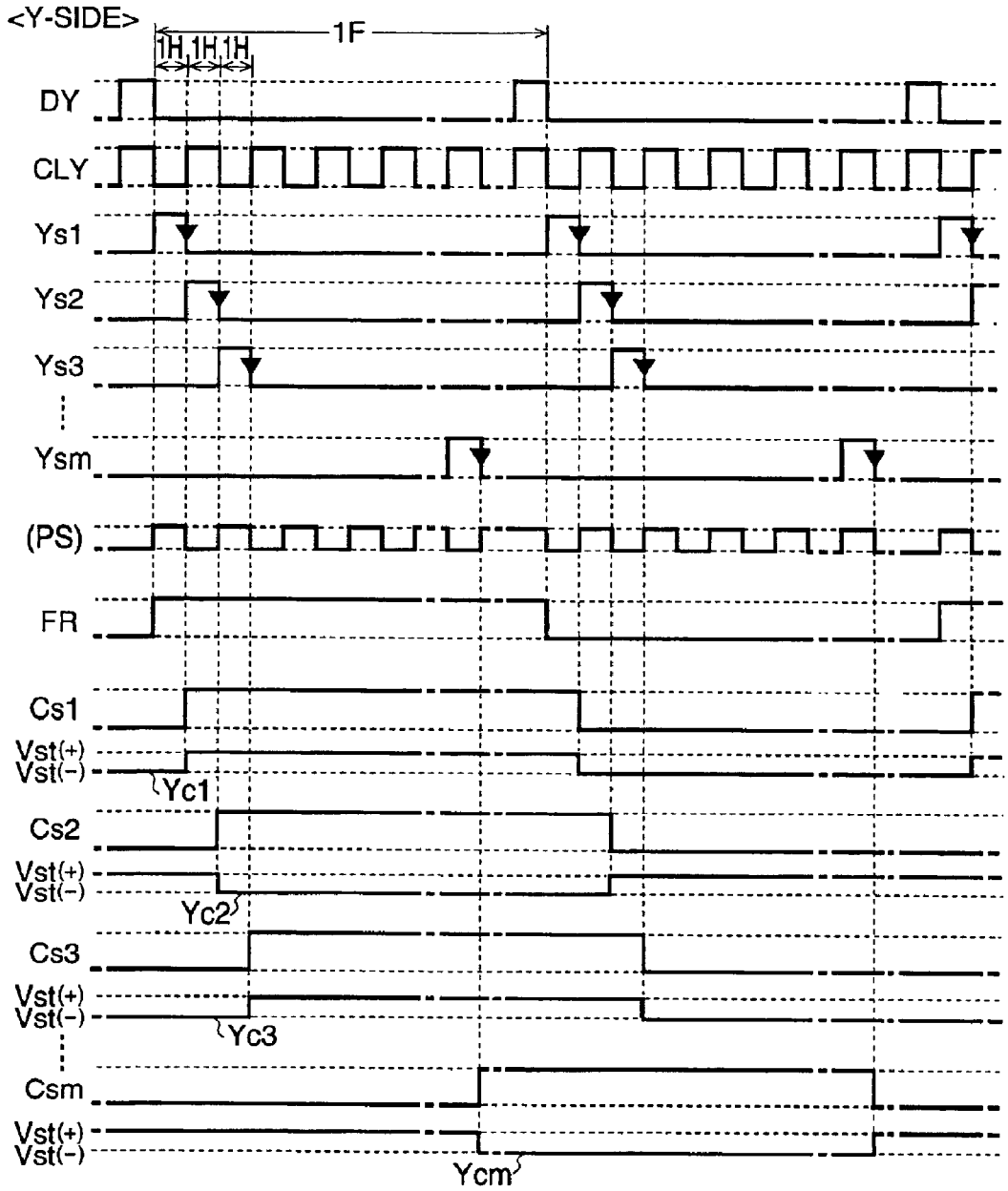
FIG. 3 is a timing chart illustrating the operation of the Y-side in the liquid crystal display device.

Now, when turning attention to the Y-side, a shift register 130 (scanning line driving circuit) is disposed. As shown in FIG. 3, the shift register 130 shifts the transmission start pulse, DY, which is supplied at the start of one vertical scanning period (1F), in sequence in response to a rise and fall of the clock signal CLY to produce the scanning signals Ys1, Ys2, Ys3, . . . , Ysm to be supplied to the first, second, third, . . . , and the mth row, respectively, of the scanning line 112. Here, as shown in FIG. 3, the scanning signals Ys1, Ys2, Ys3, . . . , Ysm become the active level (H) every one horizontal scanning period (1H) so as not to be overlapped with each other.

Next, a flipflop 132 and selector 134 (storage capacitor driving circuit) is provided for every row. Here, in general, a clock-pulse input terminal Cp of the flipflop 132 corresponding to i (i is an integer satisfying $1 \leqq i \leqq m$) is supplied with the inverted signal of the scanning signal Ysi which corresponds to the row i, and the data input terminal D is supplied with the signal FR, the logic level is inverted every one vertical scanning period (1F) (refer to FIG. 3). Thus, the flipflop 132 of the row i latches the signal FR in response to a fall of scanning signal Ysi to output a selection control signal Csi.

Then, in general, the selector 134 of the row i selects an input terminal A if the logic level of the selection control signal Csi is H, and selects an input terminal B if the logic level of the selection control signal Csi is L, and then outputs the selected signal to a capacitor line 113 of the row, 0/00 as a capacitor swing signal $Y_{ci}$.

Among the selectors 134 provided for every row, high capacitor voltage $V_{st}(+)$ is applied to the input terminal A of the selector 134 of the odd row number, and low capacitor voltage $V_{st}(-)$ is applied to its input terminal B.

On the contrary, low capacitor voltage $V_{st}(-)$ is applied to the input terminal A of the selector 134 of the even row number, and high capacitor voltage $V_{st}(+)$ is applied to its input terminal B.

Thus, the capacitor voltages applied to the input terminals A and B have an opposite relationship with respect each other at the selector 134 of the odd row number and the selector 134 of the even row number.

Figure 4:
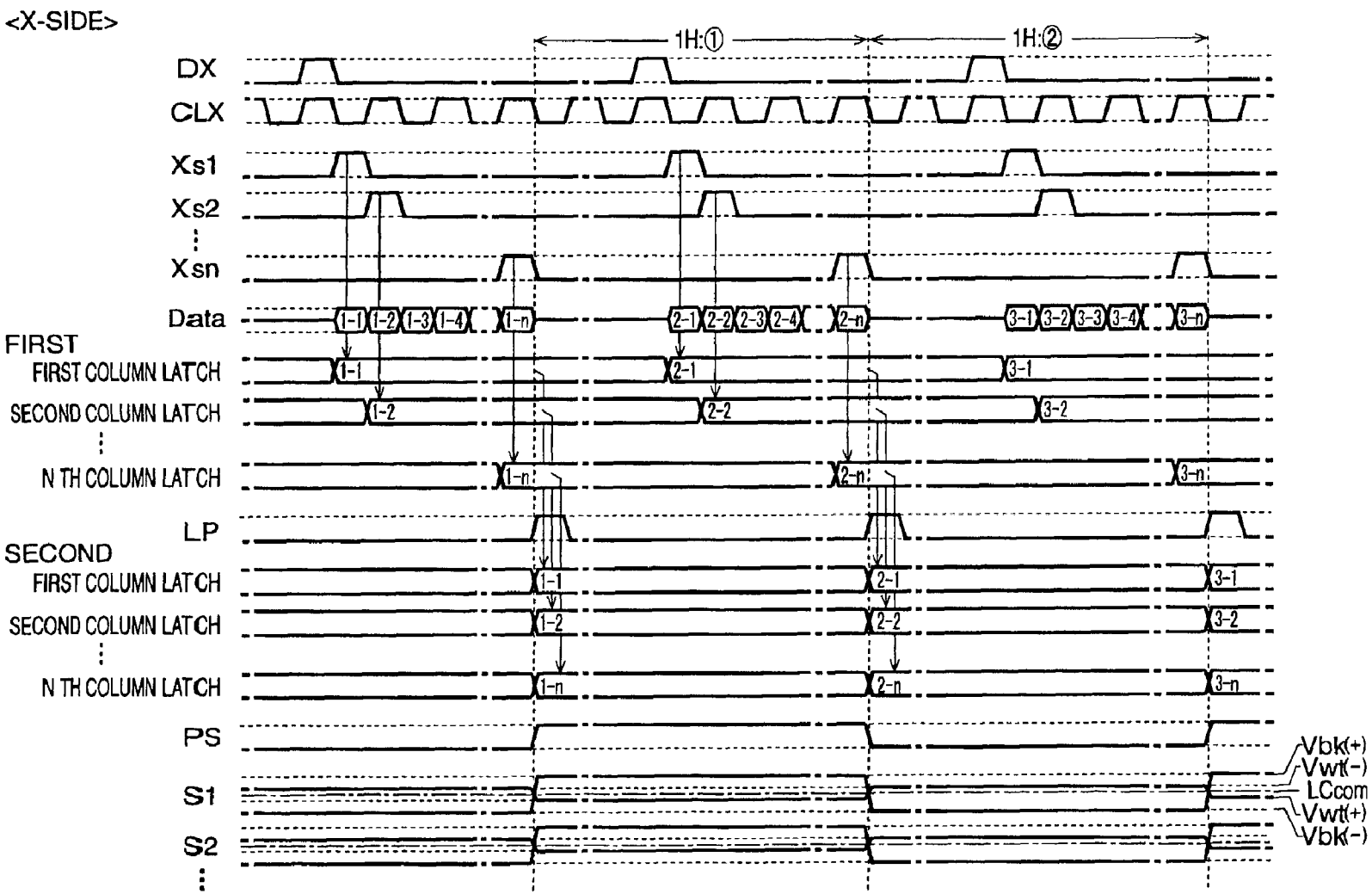
FIG. 4 is a timing chart illustrating the operation of the X-side in the liquid crystal display device.

At the same time, when turning attention to the X-side, as shown in FIG. 4, the shift register 150 shifts the transmission start pulse, DX, in sequence in response to a rise and fall of the clock signal CLX to output sampling control signals $X_{S1}$, $X_{S2}$, $X_{S3}$, . . . , $X_{Sn}$ to be active (H level) in a mutually exclusive manner. Here, the sampling control signals $X_{S1}$, $X_{S2}$, $X_{S3}$, . . . , $X_{Sn}$ become active (H level) in sequence without overlapping one another.

Now, at the output side of the shift register 150, a first sampling switch 152, a first latch circuit 154, a second sampling switch 156, a second latch circuit 158, and a D/A converter 160 are respectively provided corresponding to each column of the data line 114.

Among these elements, in general, a first sampling switch 152 corresponding to the jth column (j is an integer satisfying $1 \leqq j \leqq n$) turns on when a sampling control signal $X_{sj}$ becomes H to sample the gray scale data, DATA.

Here, gray scale data, Data, is 4-bit digital data specifying the gray scale (density) of the pixel 120. Thus, in the liquid crystal display device according to the present embodiment, the pixel 120 displays 16 (=$2^4$) gray scales according to the 4-bit gray scale data, Data. In this regard, gray scale data, Data, is supplied at a predetermined timing via the package terminal 107 (refer to FIG. 1) from the external circuit not shown in FIG. 4.

Next, a first latch circuit 154 corresponding to the column j latches the gray scale data, Data, sampled by the first sampling switch 152 corresponding to the column j.

Then, a second sampling switch 156 corresponding to the column j samples the gray scale data, Data, latched by the first latch circuit 154 corresponding to the column j when a latch pulse LP becomes active (H level).

Further, a second latch circuit 158 corresponding to the column j latches the gray scale data, Data, sampled by the second sampling switch 156 corresponding to the column j.

A D/A converter 160 of the jth column converts the gray scale data, Data, latched by the second latch circuit 158 similarly corresponding to the jth column, to the analog signal corresponding to the logical level of the signal PS to output as a data signal Sj.

Here, the signal PS is a signal directing the writing polarity to the liquid crystal capacitor, and if the logic level is H, it specifies positive-writing polarity to the pixel 120, whereas if the logic level is L, it specifies negative-writing polarity to the pixel 120. In the present embodiment, the logic level of the signal PS is inverted every horizontal scanning period (1H) as shown in FIG. 3 or FIG. 4. Additionally, the logic level of the signal PS is inverted every vertical scanning period within the same horizontal scanning period (refer to the signal in parentheses in FIG. 3). Specifically, in the present embodiment, it is arranged that the polarity is inverted by the scanning line 112.

In this regard, in the present embodiment, a polarity inversion of the pixel 120 or liquid crystal capacitor means that setting the voltage of the counter electrode 108, that is, the other terminal of the liquid crystal capacitor, as a reference, the applied voltage level is alternatively inverted.

Also, in FIG. 2, the shift register 130, flipflop 132, and selector 134 are arranged only on the left side of the array area of the pixels 120, but in practice, as shown in FIG. 1, they are disposed symmetrically about the array of the pixels 120, and are arranged to drive the scanning line and capacitor line from both the right and left sides, respectively.

<1-2: Operation of Y-side>

Next, among the operations of the liquid crystal display device according to the structure described above, Y-side operations will be described. Here, FIG. 3 is a timing chart illustrating the Y-side operations of the liquid crystal display device.

As shown in FIG. 4, the shift register 130 (refer to FIG. 2) shifts the transmission start pulse, DY, which is supplied at the start of one vertical scanning period, by a rise and fall of the clock signal CLY, and is output as the scanning signals Ys1, Ys2, Ys3, . . . , Ysm which, in sequence, exclusively turns to active level (H) for every one horizontal scanning period (1H).

Here, in one vertical scanning period (1F), when the signal FR is H, and the scanning signal Ys1 turns to H, the signal PS is turned to H (positive polarity writing is directed to the pixel 120 located at the first scanning line 112), the flipflop 132 of the first row latches the signal FR at a fall of the scanning signal $Y_S$1 thereafter.

Consequently, the selection control signal Cs1 of the flipflop 132 of the first row turns to H by a fall of the scanning signal Ys 1 (this means that TFT 116 of the pixel 120 located on the first row goes off), the selector 134 of the first row selects the input terminal A. Thus, the capacitor swing signal Yc1 supplied to the capacitor line 113 of the first row becomes the high capacitor voltage $V_{st}(+)$.

Accordingly, when the scanning signal Ys1 turns to L after the scanning signal Ys1 becomes H to direct the positive polarity writing, the capacitor swing signal Yc1 becomes high-level of the capacitor voltage $V_{st}(+)$.

Next, when the scanning signal Ys2 becomes H, the signal PS turn to L (negative polarity writing is directed to the electrode 120 located at the second scanning line 112). After this, the flipflop 132 of the second row latches the signal FR by a fall of the scanning signal Ys2. Thus, the selection control signal Cs2 turns to H when the scanning signal Ys2 falls (this means when TFT 16 of pixel 120 located on the second row goes off), thereby the selector 134 of the second row selects the input terminal A.

However, the selector 134 of even number and the selector 134 of odd number have the opposite capacitor voltage supplied to their input terminals A and B each other (Refer to FIG. 2), the capacitor swing signal Yc2 supplied to the second capacitor line 113 becomes low-level of the capacitor voltage $V_{st}(-)$ by a fall of the scanning signal Ys2.

Accordingly, when the scanning signal Ys2 turns to L after the scanning signal Ys2 becomes H to direct the negative polarity writing, the capacitor swing signal Yc2 turns to low-level of the capacitor voltage $V_{st}(-)$.

The same operation will repeat for the flipflops 132 and selectors 134 of the third, fourth, fifth, and the row m. Specifically, in one vertical scanning period (1F) in which the signal FLD is H, when the scanning signal Ysi supplied to the scanning line 112 of the row i becomes H, if i is an odd number, positive polarity writing is directed, and thereafter when the scanning signal Ysi turns to L, the capacitor swing signal Yci supplied to the capacitor line 113 of the row i turns from the low capacitor voltage $V_{st}(-)$ to high capacitor voltage $V_{st}(+)$, whereas if i is an even number, negative polarity writing is directed, and thereafter when the scanning signal Ysi turns to L, the capacitor swing signal Yci turns from the high capacitor voltage $V_{st}(+)$ to low capacitor voltage $V_{st}(-)$.

Moreover, in the next vertical scanning period, the signal FR becomes L. Thus, when the scanning signal Ysi supplied to the capacitor line 112 the row i turns from H to L, the capacitor swing signal Yci supplied to the capacitor line 113 of the row i turns from the high capacitor voltage $V_{st}(+)$ to low capacitor voltage $V_{st}(-)$ if i is an odd number, and it turns from the low capacitor voltage $V_{st}(-)$ to high capacitor voltage $V_{st}(+)$ if i is an even number.

However, the logic level of the signal PS is also inverted. Thus, when the scanning signal Ysi turns to L after directed for the positive polarity writing, the capacitor swing signal Yci turns from the low capacitor voltage $V_{st}(-)$ to high capacitor voltage $V_{st}(+)$, whereas when the scanning signal Ysi turns to L after directed for the negative polarity writing, the capacitor swing signal Yci turns from the high capacitor voltage $V_{st}(+)$ to low capacitor voltage $V_{st}(-)$, as in the same manner.

<1-3 Operation of X-side>

Next, among the operations of the liquid crystal display device, X-side operations will be described. Here, FIG. 4 is a timing chart illustrating the X-side operations of the liquid crystal display device.

First, in FIG. 4 when paying attention to one horizontal scanning period, including the period in which the scanning signal Ys1 applied to the scanning line 120 of the first row becomes H, before the one horizontal scanning period, the gray scale data Data corresponding to the pixels of the first row and first column, the first row and second column, . . . , first row and the column n are supplied in sequence. Among these, at the timing when gray scale data, Data, corresponding to the pixel of the first row and first column, when the sampling control signal Xs 1, which is output from the shift register 150, becomes H, the first sampling switch 152 corresponding to the first column is turned on, thereby the gray scale data is latched by the first latch circuit 154 corresponding to the same first column.

Next, at the timing when gray scale data, Data, corresponding to the pixel of the first row and second column, when the sampling control signal Xs2 becomes H, the first sampling switch 152 corresponding to the second column is turned on, thereby the gray scale data is latched by the first latch circuit 154 corresponding to the same second column, as in the same manner, gray scale data, Data, corresponding to the pixel of the first row and the column n is latched by the first latch circuit 154 corresponding to the column n. Consequently, the gray scale data, Data, corresponding to the pixels of the number n located at the first row are latched respectively by the first latch circuits 154 corresponding to the first column, second column, . . . , the column n.

Then, when the latch pulse LP is output (when the logic level turns to H), the gray scale data, Data, latched respectively to the first latch circuits 154 corresponding to the first column, second column, . . . , the column n is latched all at once respectively to the second latch circuits 158 corresponding to the column when the second sampling switch 156 is turned on.

Next, the gray scale data, Data, latched respectively by the second latch circuit 158 corresponding to the first column, second column, . . . , the column n is converted to the analog signal of the polarity corresponding to the logic level of the signal PS by the D/A conversion 160 respectively corresponding to the column, and is output as the data signals S1, S2, . . . ,Sn.

At this time, when the signal PS is H, the voltage of the data signal, S1, S2, . . . , Sn, corresponds to the positive-polarity writing, in detail, corresponds to the gray scale data, Data, within the range between the voltage $V_{wt}(+)$ which corresponds to positive-polarity white level and $V_{bk}(+)$ which corresponds to positive-polarity black level.

Next, when paying attention to one horizontal scanning period, including the period in which the scanning signal Ys2 supplied to the scanning line 112 of the second row becomes H (the period shown by (2) in FIG. 4), before one horizontal scanning period, the gray scale data, Data, corresponding to the pixels of the second row and first column, the second row and second column, and second row and nth column is supplied in sequence, and similar operation is executed as the previous horizontal scanning period during which the scanning signal Ys1 becomes H.

Specifically, first, when the sampling control signal Xs 1, Xs2, . . . ,Xsn, becomes H in sequence, the gray scale data Data corresponding to pixels of the second row and first column, the second row and second column, and second row and nth column is latched in the first latch circuit 154 corresponding to the first column, second column, . . . , column n. Second, the latched gray scale data, DATA, is latched to the corresponding columns of the second latch circuit 158 all at once by the latch pulse LP. Third, data signals S1, S2, . . . , Sn which have been analog-converted corresponding to the polarity of the logic level of the signal PS.

However, in the horizontal scanning period (2), the signal PS is L, thus the voltage of the data signal, S1, S2, . . . , Sn, corresponds to the negative-polarity writing, in detail, corresponds to the gray scale data, Data, within the range between the voltage $V_{wt}(-)$ which corresponds to negative-polarity white level and $V_{bk}(-)$ which corresponds to negative-polarity black level.

After this, the same operations are repeated for each time when the scanning signals Ys3, Ys4, . . . , Ysm become H.

Specifically, before one horizontal scanning period when the scanning signal Ysi supplied to the scanning line 112 of the row i becomes H, the gray scale data Data corresponding to the pixels of the ith row and first column, the ith row and second column, and ith row and nth column is supplied in sequence, and latched in the first latch circuit 154 corresponding to the first row, second row, . . . , and nth row.

Then, the latched gray scale data is latched to the corresponding columns of the second latch circuit 158 all at once by the latch pulse LP, and D/A-converted corresponding to the column by the D/A converter 160 to be output as analog signal of the polarity corresponding to the logical level of PS, thereby being output as the data signals S1, S2, . . . , Sn.

At this time, the voltages of the data signals S1, S2, . . . , Sn correspond to positive polarity writing if i is an odd number, that is, the signal PS is H, whereas the voltages correspond to negative polarity writing if i is an even number, that is, the signal PS is L.

In this regard, in the next vertical scanning period, the similar operations are performed, and within the same horizontal scanning period, the signal PS is inverted for every one vertical scanning period, thus the data signals S1, S2, . . . , Sn correspond to negative polarity writing if i is an odd number, whereas the data signals correspond to positive polarity writing if i is an even number.

<1-4: Operations of Storage Capacitor and Liquid Crystal Capacitor>

Next, a description will be provided of the operations of the storage capacitor and liquid crystal capacitor when the above-described operations of X-side and Y-side are performed. Each of FIGS. 5(*a*), 5(*b*), and 5(*c*) illustrate storage operations of the charge of these capacitors.

Figure 5:
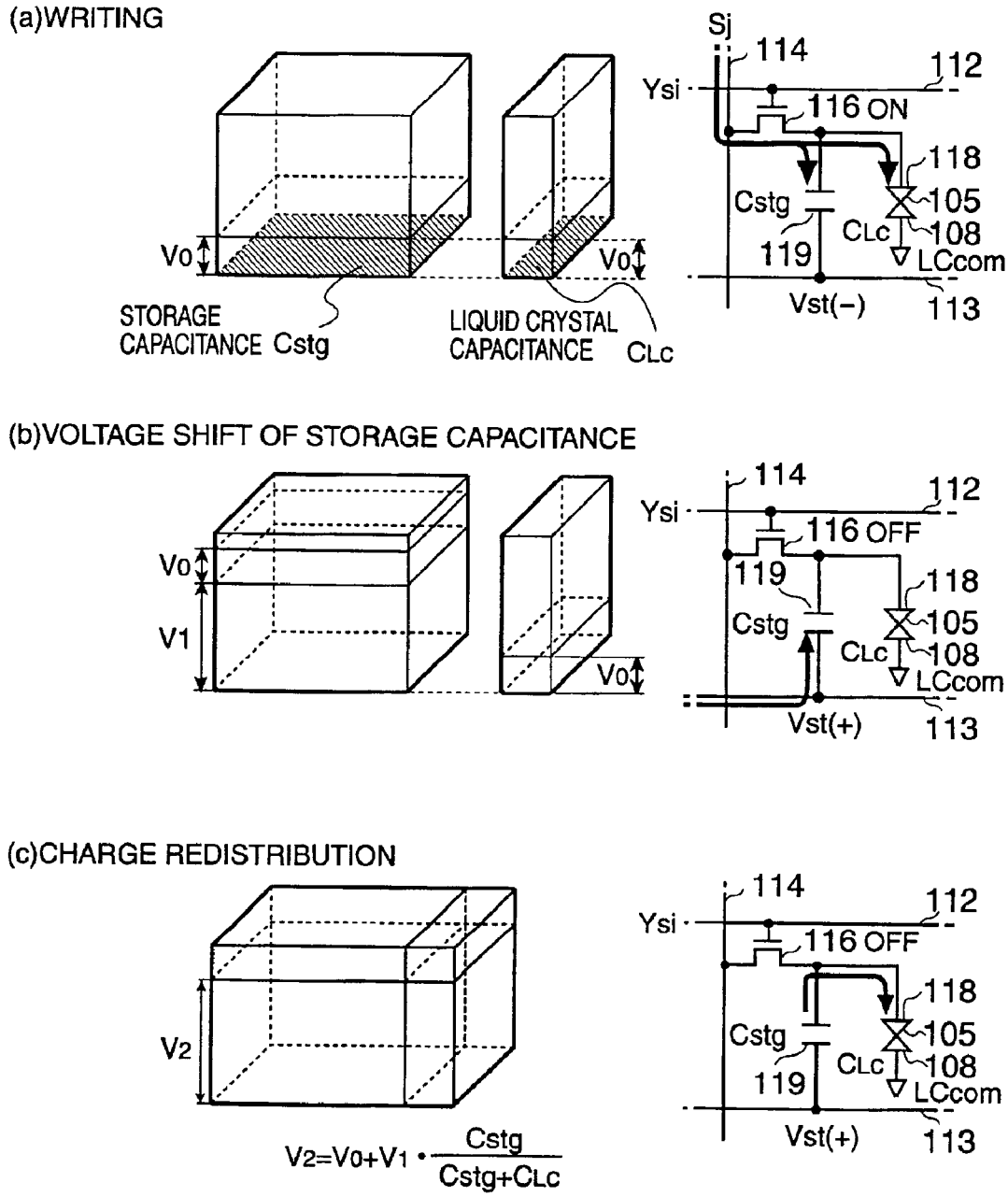
FIGS. 5(*a*), 5(*b*), and 5(*c*) each illustrate the writing operations of pixel in the liquid crystal display device.

In this regard, two measures on the left side in FIGS. 5(*a*)–5(*c*) represent a storage capacitor and a liquid crystal capacitor, respectively. For details, the areas of the bases represent the sizes of the storage capacitor $C_{stg}$ (119) and liquid crystal capacitor $C_{Lc}$, respectively, the water contained in the measures represents the charge, and its height represents the voltage.

Here, for the sake of simplification, a description is provided for performing positive-polarity writing at the pixel 120 with location of the ith row and the jth column. In this regard, the capacitor voltage of the low-level, $V_{st}(-)$, and the voltage of the counter electrode 108, LCcom are different in practice as will be described below, but for simplification of explanation, they are assumed to be the same here.

First, when the scanning signal Ysi becomes H (on-voltage), the TFT 116 of the pixel turns on. Thus, as shown in FIG. 5(*a*), the storage capacitor $C_{stg}$ and liquid crystal capacitor $C_{Lc}$ store the charge corresponding to the voltage of the data line Sj. Given that the writing voltage charged to the storage capacitor $C_{stg}$ and liquid crystal capacitor $C_{Lc}$ is V0.

Next, when the scanning signal Ysi becomes L (off-voltage), the TFT 116 of the pixel turns off, and in the case of positive-polarity writing, the capacitor swing signal Yci supplied to the capacitor line 113 of the ith row turns from the low-level capacitor voltage $V_{st}(-)$ to the high-level capacitor voltage $V_{st}(+)$ as described above. Accordingly, as shown in FIG. 5(*b*), the charging voltage of the storage capacitor $C_{stg}$ is raised by the transition component Vq. Here $Vq=\{V_{st}(+)-V_{st}(-)\}$ However, since one terminal of the storage capacitor $C_{stg}$ is connected to the pixel electrode 118, as shown in FIG. 5(*c*), the charge is transferred from the storage capacitor $C_{stg}$ of which voltage was raised to the liquid crystal capacitor $C_{Lc}$. When there is no voltage difference between both of the capacitors, transferring the charge is completed. Thus, the charging voltages of both capacitors finally become the voltage $V_2$. The voltage $V_2$ continues to be applied to the liquid crystal capacitor $C_{LC}$ for almost all of the period when TFT 116 is off. Thus, the voltage $V_2$ can be assumed to be applied to the liquid crystal capacitor $C_{Lc}$ effectively from the time when TFT 116 is on.

The voltage $V_2$ can be expressed by the following expression (1) using the storage capacitor $C_{stg}$ and the liquid crystal capacitor $C_{Lc}$.

$$V_2=V_0+V_1-C_{stg}/(C_{stg}+C_{Lc}) \quad (1).$$

Here, if the storage capacitor $C_{stg}$ is larger by far than the liquid crystal capacitor $C_{Lc}$, expression (1) can be approximated by the following expression (2).

$$V_2=V_0+V_1 \quad (2)$$

Specifically, final voltage applied to the liquid crystal capacitor $C_{Lc}$, that is, $V_2$ is simplified as the initial writing voltage, $V_0$ shifted high-level as much as $V_1$, that is, the raised amount of the capacitor swing signal Yci.

In this regard, here, the operations as shown in FIGS. 5(*b*) and 5(*c*) are explained separately for the sake of simplification, but in practice, both operations occur concurrently. Also, a description is provided of the case where positive-polarity writing is performed. However, in the case of negative-polarity writing, if the storage capacitor $C_{stg}$ is by far larger than the liquid crystal capacitor $C_{Lc}$, the final voltage applied to the liquid crystal capacitor $C_{Lc}$, that is, $V_2$ is the initial writing voltage, $V_0$, shifted low-level as much as $V_1$, that is, the raised amount of the capacitor swing signal Yci.

Figure 6:
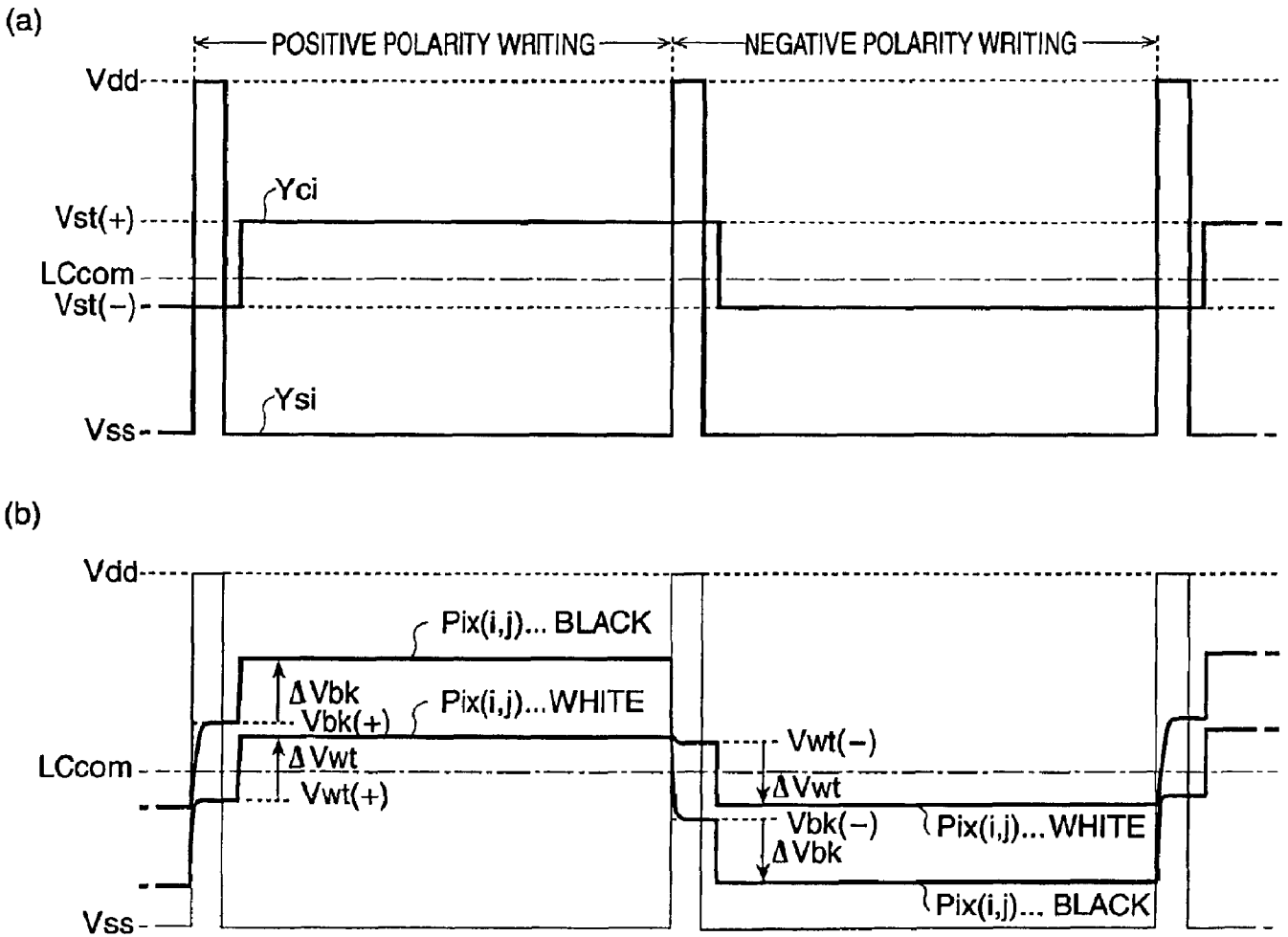
FIG. 6(*a*) is a chart that shows voltage waveforms of a scanning signal and a capacitor swing signal in the liquid crystal display device, and FIG. 6(*b*) is a chart that shows voltage waveforms applied to pixel electrodes in the liquid crystal display device.

When actually performing positive-polarity writing to the pixel 120 located at ith row and jth column, as described above, at the time when TFT116 is on at the pixel, the voltage of the capacitor swing signal Yci applied to the ith capacitor line 113, that is, the other terminal of the storage capacitor, $C_{stg}$ (119), at the pixel is low-level capacitor voltage $V_{st}(-)$, and the voltage of the counter electrode 108, that is, the other terminal of the liquid crystal capacitor, $C_{LC}$, is a constant LCcom (refer to FIG. 6(*a*)). Thus, the reference voltage of the charging voltage of the storage capacitor, $C_{stg}$, and the reference voltage of the charging voltage of the liquid crystal capacitor $C_{LC}$ is different from each other.

However, the voltage Pix (i, j) applied to the pixel electrode 118 of the pixel 120 with i rows and j columns becomes, as shown in FIG. 6(*b*), first the voltage of the data signal Sj supplied to the data line 114 of the column j once when TFT 116 is on, and second, immediately after TFT 116 is off, if it is a positive-polarity writing, the capacitor swing signal Yci changes from low-level capacitor voltage $V_{st}(-)$ to the high-level capacitor voltage $V_{st}(+)$, thereby shifts to the high-level, whereas if it is a negative-polarity writing, the capacitor swing signal Yci changes from high-level capacitor voltage $V_{st}(+)$ to the low-level capacitor voltage $V_{st}(-)$, thereby shifts to the low-level. Also, the shift amount depends on the writing voltage of the data signal Sj and the ratio of the storage capacitor $C_{stg}$ and the liquid crystal capacitor $C_{Lc}$, which is the same description regarding FIGS. 5(*a*), 5(*b*), and 5(*c*).

In this regard, FIG. 6(*b*) shows the following four points: that is, the voltage Pix (i, j) of the pixel electrode 118 of the pixel 120 at the ith row and the jth column shifts as much as ΔVwt which depends on the voltage Vwt(+) and the ratio of storage capacitor $C_{stg}$ and the liquid crystal capacitor $C_{Lc}$ to the high-level immediately after TFT 116 is off when the voltage is Vwt(+) which corresponds to white level of positive-polarity writing when TFT 116 is on; the voltage Pix (i, j) of the pixel electrode 118 shifts as much as ΔVbk which depends on the voltage Vbk(+) and the ratio of storage capacitor $C_{stg}$ and the liquid crystal capacitor $C_{Lc}$ to the high-level immediately after TFT 116 is off when the voltage is Vbk(+) which corresponds to black level of positive-polarity writing when TFT 116 is on; the voltage Pix (i, j) of the pixel electrode 118 shifts as much as ΔVwt which depends on the voltage Vwt(−) and the ratio of storage capacitor $C_{stg}$ and the liquid crystal capacitor $C_{Lc}$ to the low-level immediately after TFT 116 is off when the voltage is Vwt(−) which corresponds to white level of negative-polarity writing when TFT 116 is on; the voltage Pix (i, j) of the pixel electrode 118 shifts as much as Δvbk which depends on the voltage Vbk(+) and the ratio of storage capacitor $C_{stg}$ and the liquid crystal capacitor $C_{Lc}$ to the low-level immediately after TFT 116 is off when the voltage is Vbk(−) which corresponds to black level of negative-polarity writing when TFT 116 is on.

As described above, according to the present embodiment, the voltage of the pixel electrode 118 changes no less than the voltage swing of the data signals S1, S2, S3 . . . , and Sn supplied to the data line 114. Specifically, according to the present embodiment, even if the voltage swing range is small, the effective voltage applied to the liquid crystal capacitor is enlarged more than the range. As a result, a level shifter which has been provided at the output of the D/A converter 160 in order to enlarge the voltage of the data signal conventionally becomes unnecessary, thus free space increases in circuit layout for that amount, and further making it possible to reduce wasted power which has increased with the voltage increase. In addition, all of the circuits from X-side shift register 150 to D/A converter 160 can be driven by low voltage, thus making it possible to make the elements (TFT) constituting these circuits small. Accordingly, it is possible to make the pitch of the data line 114 narrower, thereby making it easy to provide high-definition.

Further, in the present embodiment, the other terminal of the storage capacitor $C_{stg}$ is connected to the scanning line 112, and there are following advantages over the methods of driving scanning lines with multiple values (for example, refer to the techniques disclosed in Japanese Unexamined Patent application Publication Nos. 2-913 and 4-145490).

Specifically, in the method of driving scanning lines with multiple values, as more storage capacitor is connected to the scanning line, the larger the load becomes. However, in general, the voltage swing of the scanning signal supplied to a scanning line is greater than the voltage swing of the data signal supplied to the data line (refer to FIG. 6(*a*)). Accordingly, in the method of driving scanning lines with multiple values, high voltage swing is applied to the scanning line appended the load, thus more power is consumed, thereby making it difficult to reduce power consumption.

On the contrary, in a present embodiment, the other terminal of the storage capacitor $C_{stg}$ ( 119) is raised or lowered by the capacitor swing signal supplied to the capacitor line 113. Thus, the effective voltage applied to the liquid crystal capacitor is enlarged, the capacitor appended to the scanning line is not changed, and the smaller the voltage swing of the data signal is maintained, the smaller can be the voltage swing of the scanning signal, thereby making it possible to reduce power consumption.

Also, in the present embodiment, the following advantages are achieved over the method of shifting (raising or lowering) the voltage of the counter electrode for each certain period (for example, one horizontal scanning period). Specifically, if the voltage of the counter electrode is shifted, all the parasitic capacitors of the counter electrode are affected all at once, thus power consumption cannot be reduced as intended.

On the contrary, in the present embodiment, the voltage of the capacitor line 113 shifts only for every horizontal scanning period in sequence. Thus, within one horizontal scanning period, only the parasitic capacitor of one capacitor line 113 is affected. As a result, according to the present embodiment, the capacitor affected by the shifting of the voltage is by far less than that of the method in which the voltage of the counter electrode is shifted, thereby the present embodiment is more advantageous than the other methods in reducing power consumption.

<1-5 Considerations>

As described above, if the storage capacitor $C_{stg}$ is by far larger than the liquid crystal capacitor $C_{Lc}$, the final voltage applied to the liquid crystal capacitor $C_{Lc}$, that is, $V_2$ can be handled as the initial writing voltage, $V_0$ shifted high-level or low-level as much as the voltage shift amount of the capacitor swing signal Yci (the voltage shift amount at the other terminal of the storage capacitor).

However, in practice, due to restrictions of layout of circuit element and wiring and other considerations, the storage capacitor is limited to about several-fold the amount of the liquid crystal capacitor $C_{Lc}$ practically. Thus, the voltage shift amount (raised amount or lowered amount) of the capacitor swing signal Yci does not become the voltage shift amount of the pixel electrode. Specifically, the voltage shift amount of the capacitor swing signal Yci is compressed and reflected as the voltage shift amount of the pixel electrode 118.

Figure 7:
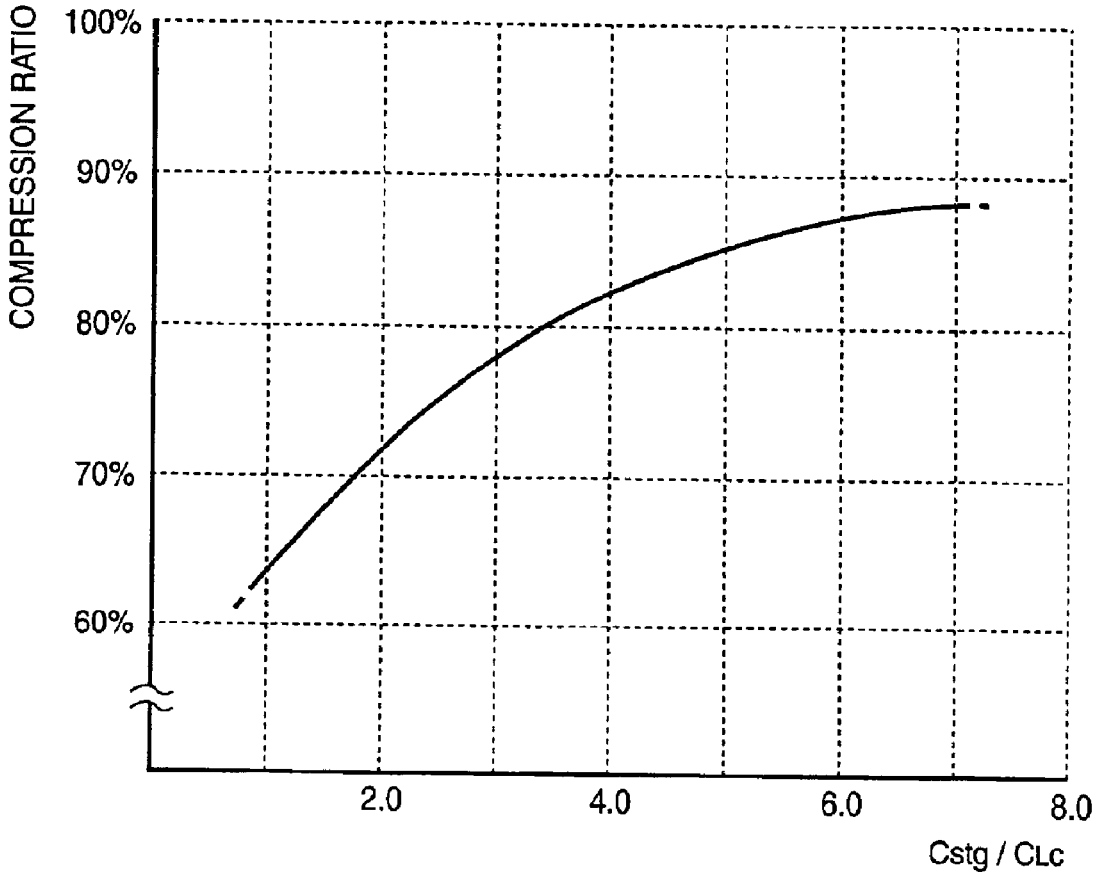
FIG. 7 is a graph that shows the relationship between the ratio of storage capacitance to liquid crystal capacitance and the compression ratio of the output voltage in the liquid crystal display device.

Here, FIG. 7 is a graph that simulates how the compression rate changes for the rate of storage capacitor $C_{stg}$/liquid crystal capacitor $C_{Lc}$. For example, when the voltage shift of the other terminal of storage capacitor is 2.0 volts, if the voltage shift of the pixel electrode is 1.5 volts, the compression rate is 75%.

As shown in FIG. 7, as the rate of storage capacitor $C_{stg}$/liquid crystal capacitor $C_{Lc}$ increases, the compression rate increases, but the rate will be saturated in the end. Especially, when the rate of storage capacitor $C_{stg}$/liquid crystal capacitor $C_{Lc}$ is about to exceed "4", the compression rate is saturated at 80% or more. Here, if the rate of storage capacitor $C_{stg}$/liquid crystal capacitor $C_{Lc}$ is about "4", the decrease amount of the voltage swing is at least 20% or less. Thus, it is realistic from the point of layout.

In order to compensate the decrease amount of the voltage swing, first, there is a method to increase the voltage swing of the initial writing voltage of the data signal supplied to the data line 114. However, this is contrary to the object of the present invention, and thus it cannot be easily applied. Particularly, if the output voltage swing of the D/A converter 160 is greater than the voltage swing of logical level of the circuits from the shift register 150 to the second latch circuit 158, a level shifter that enlarges the voltage swing at the output of D/A converter 160 becomes necessary, thereby making it difficult to reduce power consumption greatly. In other words, in the structure as shown in FIG. 2, it is necessary that the output voltage swing of the D/A converter 160 is not greater than the voltage swing of logical level of the circuits from the shift register 150 to the second latch circuit 158.

In order to compensate the decreased amount of the voltage swing, second, there is a method to increase the voltage shift of the capacitor swing signal Yci. However, even if the voltage shift is enlarged too much, it is difficult to achieve the primary purpose of reducing power consumption.

Accordingly, the present inventors simulated the relationship between the voltage swings of the capacitor swing signal Yci (that is, voltage shift of the other terminal of the storage capacitor) and maximum-voltage-output swings of the data signal D/A converted by the D/A converter 160. The result of these simulations are each shown in FIGS. 8(*a*), 8(*b*), 8(*c*), 9(*a*), 9(*b*), and 9(*c*).

Figure 8:
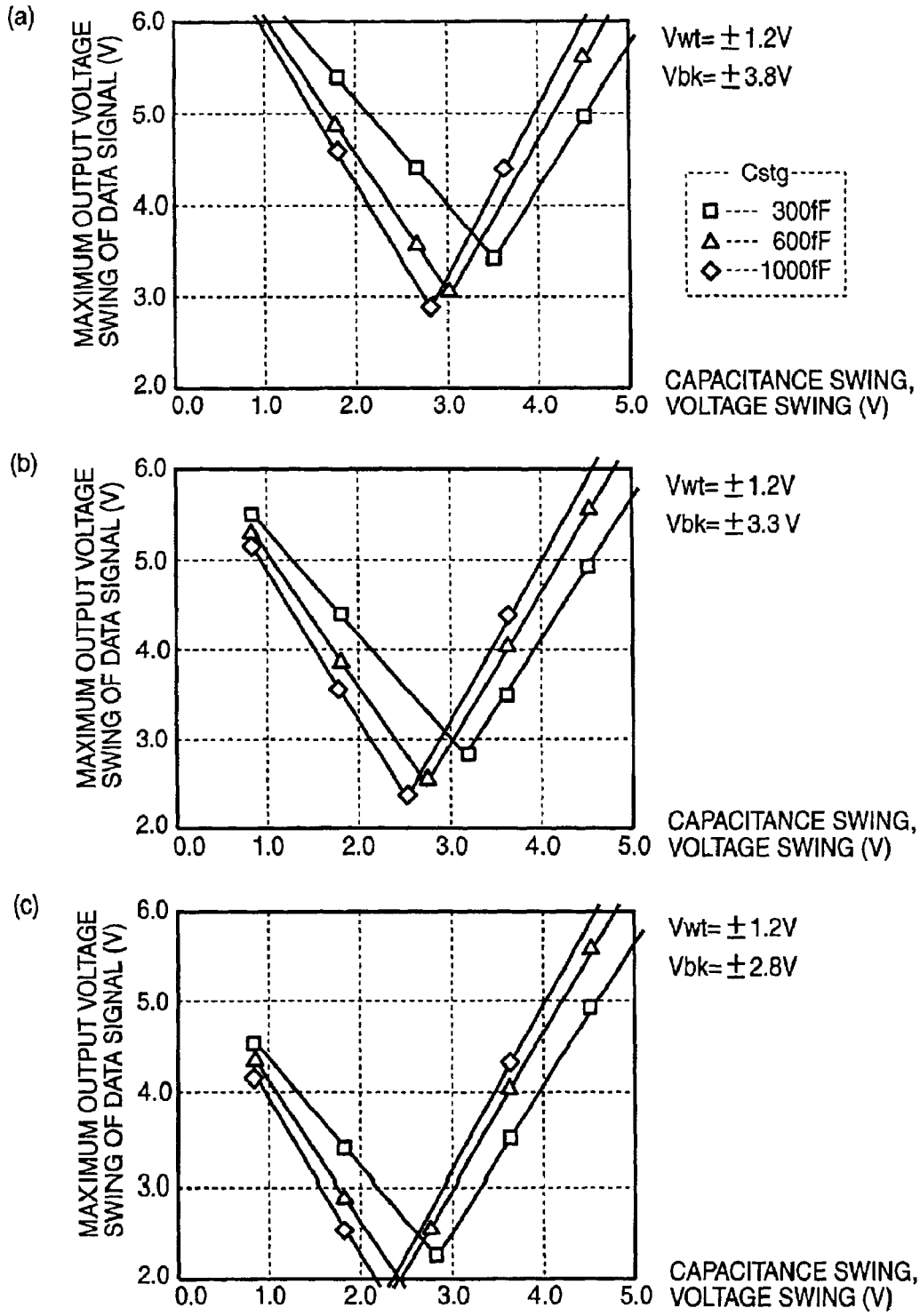
FIGS. 8(*a*), 8(*b*), and 8(*c*) are graphs that each show the relationship between the amount of voltage shift at the other end of the storage capacitance and the maximum output voltage swing of the data line.

Among these figures, FIGS. 8(*a*), 8(*b*), and 8(*c*) represent when the finally applied voltage to the pixel electrode for the voltage of the counter electrode is, as for the white level, it is fixed as ±1.2 volts, and as for black level it is varied as ±2.8 volts, ±3.3 volts, and ±3.8 volts.

Figure 9:
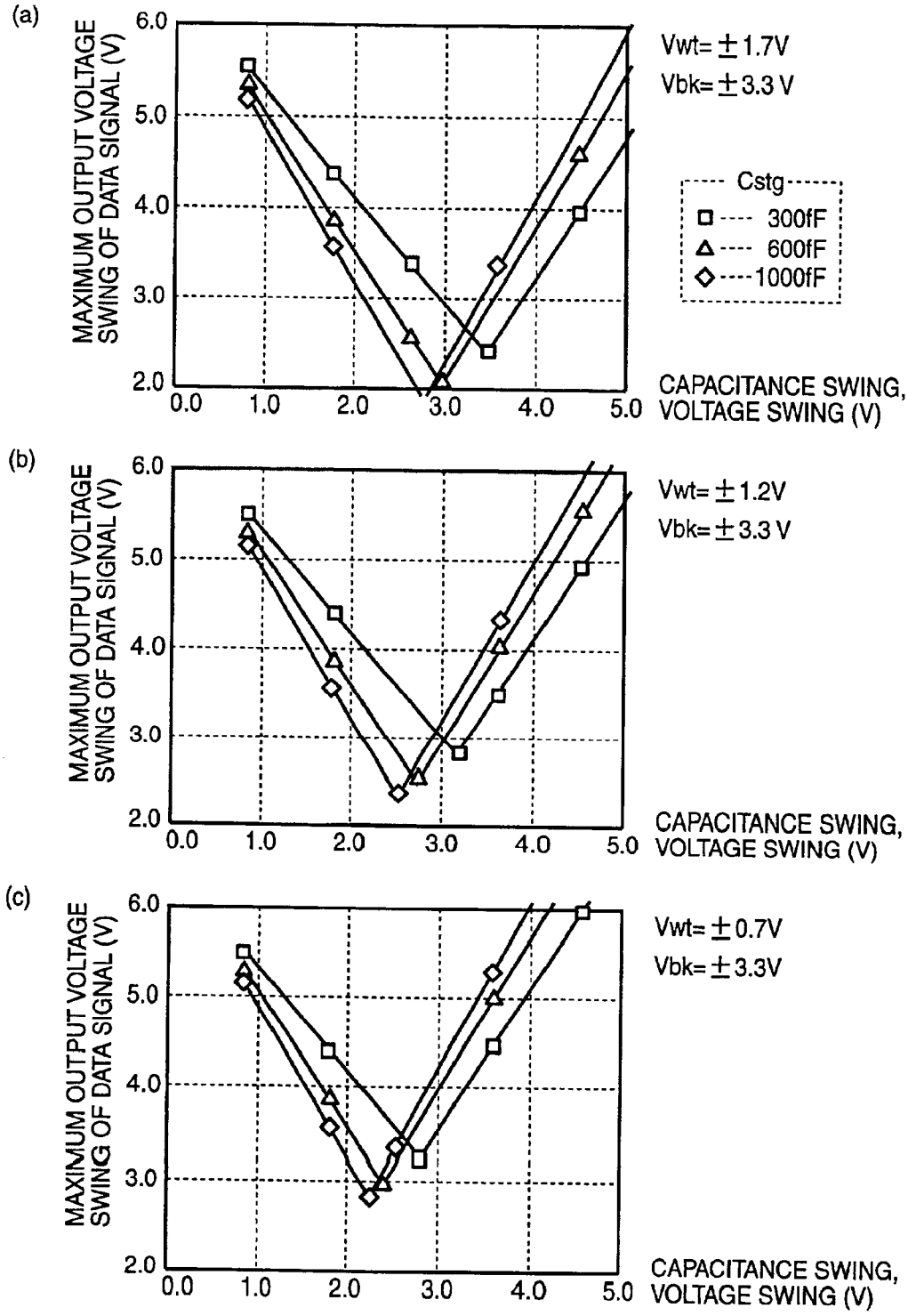
FIGS. 9(*a*), 9(*b*), and 9(*c*) are graphs that each show the relationship between the amount of voltage shift at the other end of the storage capacitance and the maximum output voltage swing of the data line.

Also, among these figures, FIGS. 9(*a*), 9(*b*), and 9(*c*) represent when the finally applied voltage to the pixel electrode for the voltage of the counter electrode is, as for the black level, it is fixed as ±3.3 volts, and as for white level it is varied as ±0.7 volts, ±1.2 volts, and ±1.7 volts.

In this regard, in all these figures, the storage capacitor $C_{stg}$ is set as a parameter, and normally white mode is assumed to be employed. Also, the liquid crystal capacitor, which is simulated, is assumed to have a pixel electrode of 50 μm×150 μm, a distance between pixel electrode and counter electrode (cell gap) of 4.0 μm, a relative dielectric constant of 4.0 at white level and 12.0 at black level 12.0.

In all these simulation results, maximum output voltage swings of the data signals have minimum values for the voltage swing of the capacitor swing signal Yci. Among these, in FIGS. 8(*a*), 8(*b*), and 8(*c*), as the voltage becomes larger for the black level, in a V-shaped characteristic, only the maximum output voltage swing of the left-side part increases, but the right-side part does not increase. In FIGS. 9(*a*), 9(*b*), and 9(*c*), as the voltage becomes larger for the white level, in a V-shaped characteristic, only the maximum output voltage swing of the right-side part increases, but the left-side part does not increase.

Accordingly, from the above, the minimum value of the maximum output voltage swing of the data signal is determined by the voltage corresponding to white/black level and the storage capacitor $C_{stg}$.

For example, when combining the left-side part of the V-shaped characteristic in FIG. 8(*a*), and the right-side part of the V-shaped characteristic in FIG. 9(*c*), the maximum output voltage swing of the data signal can be kept 5.0 volts or less if the voltage swing of the capacitor swing signal Yci is in the range between 1.8 and 3.5 volts.

Particularly, when the storage capacitor $C_{stg}$ can be designed relatively freely, if the storage capacitor $C_{stg}$ is set to about 600 fF (femto farad), the maximum output voltage swing of the data signal may be kept 4.0 volts or less.

As a result, even if the maximum output voltage swing of the data signal, that is the output of the D/A converter 160, is maintained at 5.0 volts or less under the conditions that voltage swings of the logic levels of the circuits from the shift register 150 to the second latch circuit 158 is 5.0 volts, in the present embodiment, it is possible to perform writing sufficiently to the liquid crystal capacitors.

<2: Second Embodiment>

In the first embodiment as described above, the capacitor line 113 is commonly used for the electrode 120 of each row. Thus, when performing alternating driving of the liquid crystal capacitors, only the inversion per scanning line (row inversion) or inversion per vertical scanning period (frame inversion) can be applied, thereby enabling the remaining factors to increase the power consumption.

Accordingly, a description will be provided of a second embodiment in which the above shortcoming is enhanced to in some degree. The overall structure of the liquid crystal display device according to the second embodiment is the same as that of the first embodiment as shown in FIG. 1. Thus, the description about this feature is omitted, and the electrical structure will be described.

Figure 10:
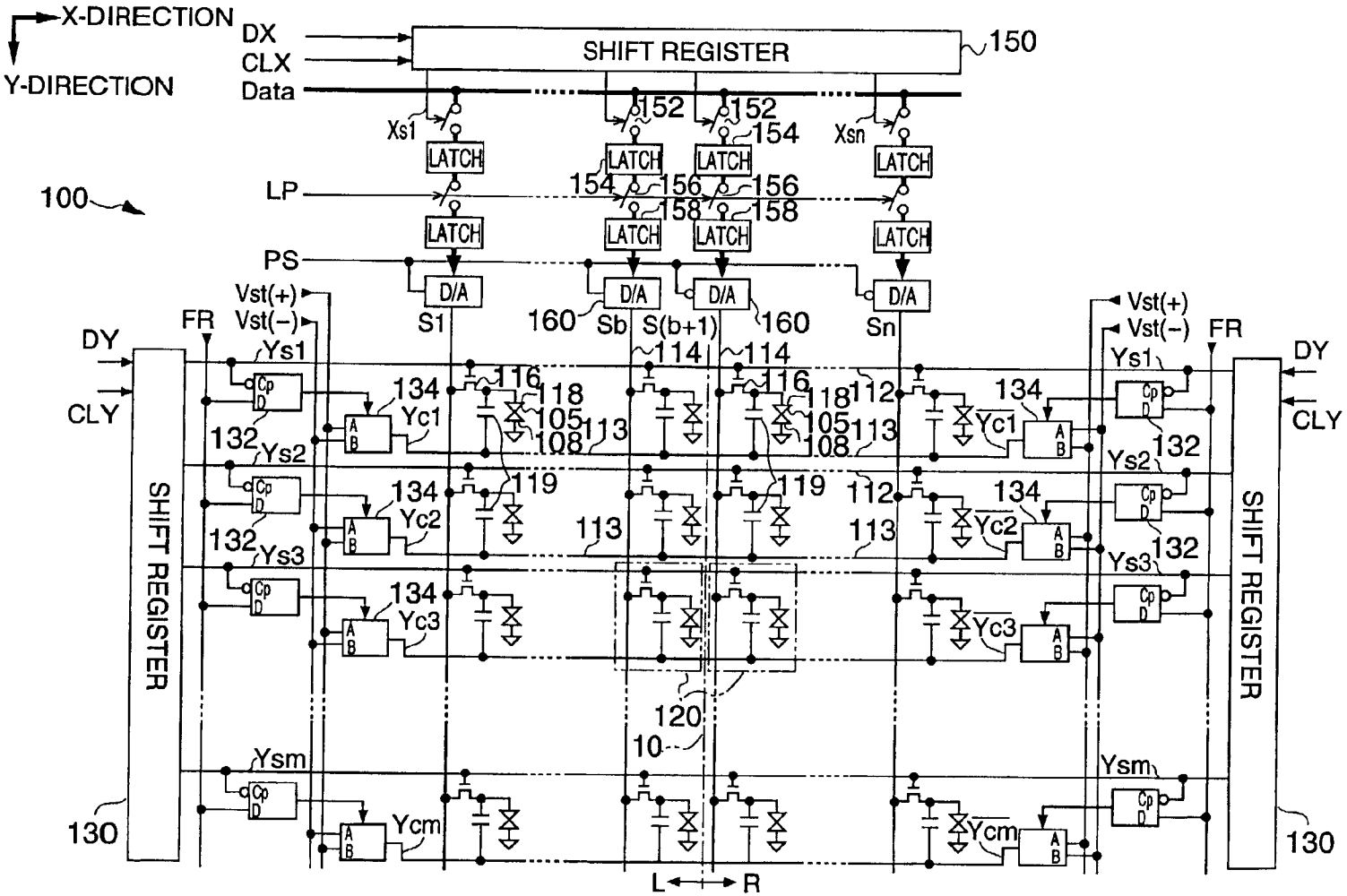
FIG. 10 is a schematic showing the electrical structure of the liquid crystal display device according to a second embodiment of the present invention.

FIG. 10 is a schematic illustrating the electrical structure of the liquid crystal display device according to the second embodiment of the present invention.

As shown in FIG. 10, in the second embodiment, the area in which the pixels 120 are arranged is divided by the boundary line 10 into a left-half area, L, and a right-half area, R. Here, for the sake of explanation, given that the data lines 114 from the first column to the bth column are included in the left-half area, L, and the data lines 114 from the (b+1)th column to the nth column are included in the right-half area, R.

At the same time, this embodiment is the same as the first embodiment in that the scanning line 112 is commonly used for each row. However, in the present embodiment, the capacitor line 113 is divided by the boundary line 10. Thus, in the second embodiment, the scanning line 113 is not commonly used for all the pixels 120 of each row, but separately used in common for each row by the pixels 120 of the left-half area, L, and by the pixels of the right-half area, R.

Next, the arrangement of shift registers 130, flipflops 132, and selectors 134 in left-half area L and right-half area R is not different from that of the first embodiment (in FIG. 2, the arrangement corresponding to the right-half area is omitted), the voltages supplied to the input terminals A and B of the selectors 134 covering the right-half area Rand the voltages supplied to the input terminals A and B of the selectors 134 covering the left-half area L have an opposite relationship with each other.

In detail, for odd number rows, the voltage of the input terminal A of the selector 134 covering the left-half area L is the high-level capacitor voltage $V_{st}(+)$, and the voltage of the input terminal B is the low-level capacitor voltage $V_{st}(-)$, whereas the voltage of the input terminal A of the selector 134 covering the right-half area R is the low-level capacitor voltage $V_{st}(-)$, and the voltage of the input terminal B is the high-level capacitor voltage $V_{st}(+)$. On the contrary, for the even number rows, the voltage of the input terminal A of the selector 134 covering the left-half area L is the low-level capacitor voltage $V_{st}(-)$, and the voltage of the input terminal B is the high-level capacitor voltage $V_{st}(+)$, whereas the voltage of the input terminal A of the selector 134 covering the right-half area R is the high-level capacitor voltage $V_{st}(+)$, and the voltage of the input terminal B is the low-level capacitor voltage $V_{st}(-)$.

Consequently, for ith row, a capacitor swing (this means inversion)Ysi of the selector 134 covering the right-half area R and a capacitor swing Ysi of the selector 134 covering the left-half area L have an opposite relationship with each other.

The structure is made for the X-side, in the same manner as in the first embodiment, that the shift registers 150, first sampling switches 152, first latch circuits 154, second sampling switches 156, second latch circuits 158, and D/A converters 160 are arranged, and for the D/A converters 160 covering the right-half area R, the inverted signal of the signal PS is supplied.

Figure 11:
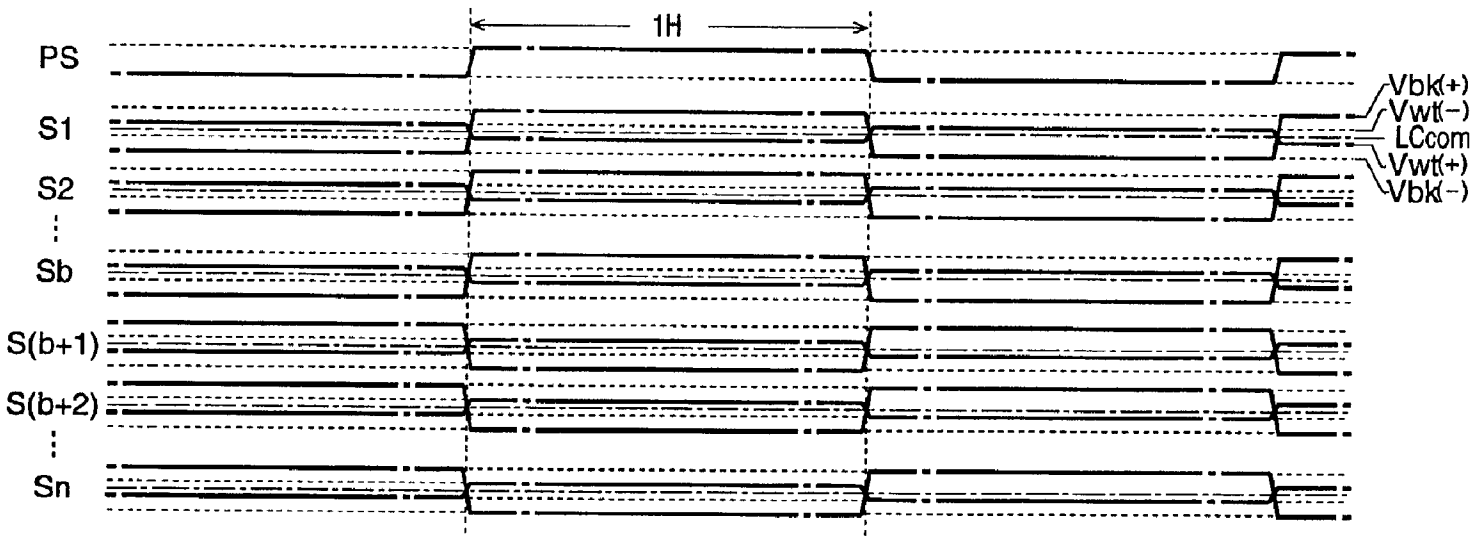
FIG. 11 is a timing chart illustrating the operation of the liquid crystal display device.

Thus, as shown in FIG. 11, the data signals S1, S2, Sb which are supplied to the data lines 144 in the left-half area L and the data signals S(b+1), S(b+2), Sn which are supplied to the data lines 144 in the right-half area R have an opposite polarity with each other.

Accordingly, in the second embodiment, together with inversion for each scanning line, different polarity writings are performed each other in the left-half area L and right-half area R. As a result, in the second embodiment, when comparing with the first embodiment in which a simple inversion is performed for each scanning line, the rush current to the counter electrode 108 is decreased thereby making it possible to reduce power consumption.

<3: Third Embodiment>

In the second embodiment, it is true that the power consumption can be reduced as compared to the first embodiment. However, the capacitor lines 113 are divided by the boundary 10. Thus, this will increase the time constant. Consequently, even if the densities of both sides are specified the same, a density difference between the pixels 120 of the both sides of the boundary 10 may occur, thereby deteriorating the display quality.

Accordingly, a description will be provided of the third embodiment in which enhancements are made for the shortcoming of the deterioration of the display quality. In this regard, since the overall structure of the liquid crystal display device according to the third embodiment is the same as that of the first and the second, the description is omitted. Thus, a description will be provided from the electrical structure.

Figure 12:
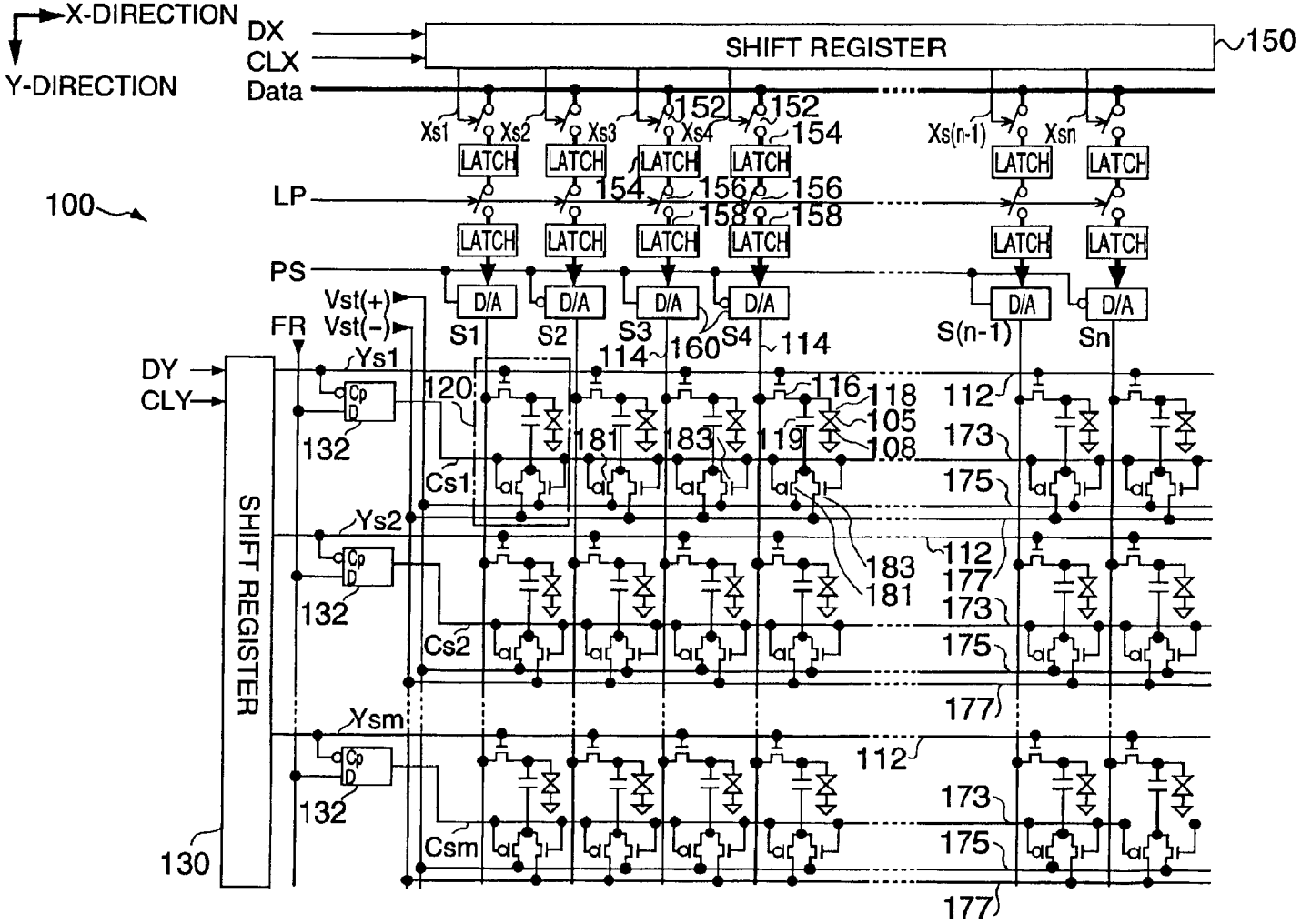
FIG. 12 is a schematic showing the electrical structure of the liquid crystal display device according to a third embodiment of the present invention.

FIG. 12 is a schematic illustrating the electrical structure of the liquid crystal display device according to the third embodiment of the present invention.

As shown in FIG. 12, the third embodiment is in common with the first embodiment in that the scanning lines 112 are arranged for each one row. However, the third embodiment is different from the first embodiment in that instead of the capacitor lines 113, the selection signal lines 173 and also high-level capacitor lines 175 and low-level capacitor lines 177 are newly arranged.

Here, the selection signal line 173 of ith row is supplied with the selection control signal Csi by the flipflop 132 of the ith row. Also, high-level capacitor line 175 is applied with high-level capacitor voltage $V_{st}(+)$, and low-level capacitor line 177 is applied with low-level capacitor voltage $V_{st}(-)$. Thus, the selector 134 arranged for each row in the second embodiment is obviated.

Also, in the third embodiment, the arrangement of the pixels 120 have been changed from the first embodiment with reference to the point that the selection signal lines 173 and also high-level capacitor lines 175 and low-level capacitor lines 177 are newly arranged.

Specifically, in the third embodiment, a P-channel-type TFT 181 is inserted between the other terminal of the storage capacitor 119 and low-level capacitor line 177 of the pixel 120 which has either an odd number row and an odd number column, or an even number row and an even number column, and also, an N-channel-type TFT 183 is inserted between the other terminal of the storage capacitor 119 and high-level capacitor line 175. Then, both gates of a P-channel-type TFT181 and an N-channel-type TFT183 are commonly connected with the selection signal line 173.

Thus, the other terminal of the storage capacitor 119 of the pixel 120, which has either an odd number row and an odd number column, or an even number row and an even number column, becomes the high-level capacitor voltage $V_{st}(+)$ when the selection signal line 173 is H, and becomes the low-level capacitor voltage $V_{st}(-)$ when the selection signal line 173 is L.

On the other hand, the insertion relationship of a P-channel-type TFT 181 and an N-channel-type TFT 183 of the pixel 120, which has either an odd number row and an even number column, or an even number row and an odd number column is opposite to that of the pixel 120, which has either an odd number row and an odd number column, or an even number row and an even number column.

Specifically, an N-channel-type TFT 183 is inserted between the other terminal of the storage capacitor 119 and low-level capacitor line 177 of the pixel 120, which has either an odd number row and an even number column, or an even number row and an odd number column, and also, a P-channel-type TFT 181 is inserted between the other terminal of the storage capacitor 119 and high-level capacitor line 175.

Thus, the other terminal of the storage capacitor 119 of the pixel 120 which has either an odd number row and an even number column, or an even number row and an odd number column becomes the low-level capacitor voltage $V_{st}(-)$ when the selection signal line 173 is H, and becomes the high-level capacitor voltage $V_{st}(+)$ when the selection signal line 173 is L.

Accordingly, in the third embodiment, the other terminal of the storage capacitors 119 of an odd number row and an odd number column, or an even number row and an even number column, and that of an odd number row and an even number column, or an even number row and an odd number column are arranged to have an opposite capacitor voltage each other.

Further, in the third embodiment, in the same manner as in the first embodiment, the shift registers 150, first sampling switches 152, first latch circuits 154, second sampling switches 156, second latch circuits 158, and D/A converters 160 are arranged. However, D/A converters 160 of even number column are arranged to be supplied with the inverted signal of the signal PS.

Figure 13:
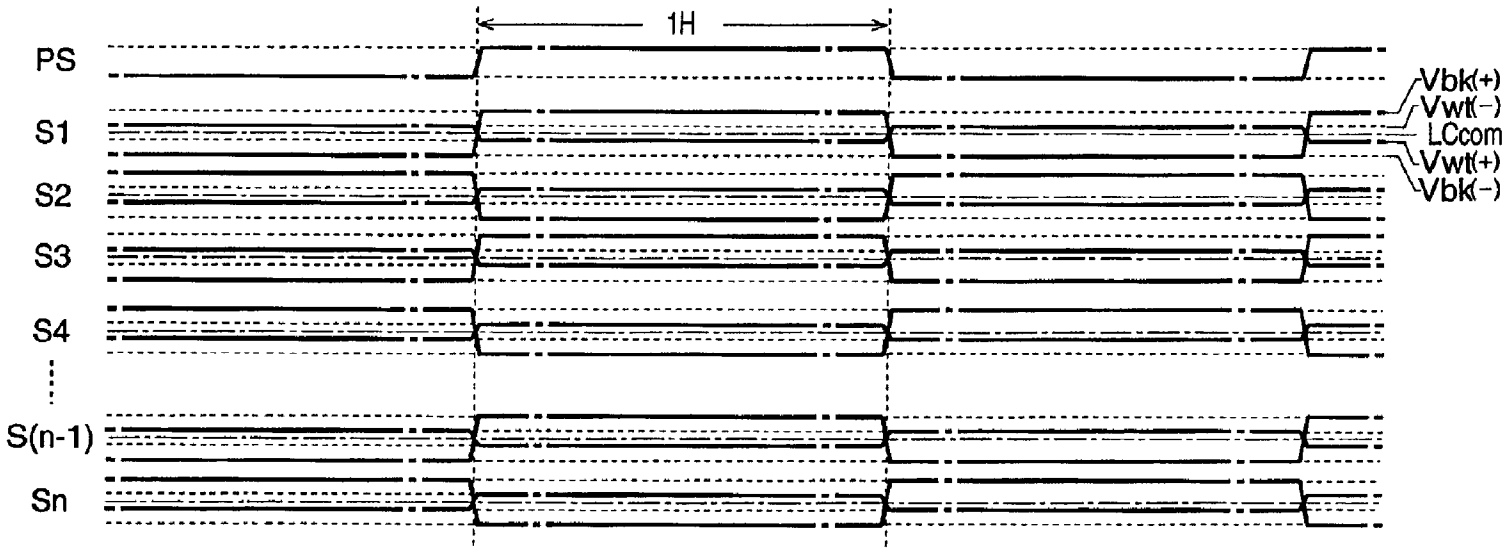
FIG. 13 is a timing chart illustrating the operation of the liquid crystal display device.

Accordingly, the data signals S1, S3, . . . , S(n−1) supplied to the data lines 114 of the odd number column and the data signals S2, S4, . . . , Sn supplied to the data lines 114 of the even number column have an opposite polarity to each other as shown in FIG. 13.

As a result, in the third embodiment, the polarities of all of the adjacent pixels are inverted. This means that pixel inversion is performed. Thus, in the third embodiment, as compared with the second embodiment, rush current is greatly reduced, thereby making it possible to further reduce the power consumption, and also to prevent deterioration of display quality caused by flickering and so on.

In this regard, in the third embodiment, in order to perform pixel inversion, the other terminal of the storage capacitors 119 of an odd number row and an odd number column, or an even number row and an even number column, and that of an odd number row and an even number column, or an even number row and an odd number column are arranged to have an opposite capacitor voltage each other, and also the data signals of the an odd number column and an even number column have an opposite polarity each other. However, it can also be arranged that simply the other terminal of the storage capacitors 119 of an odd number column and the other terminal of the storage capacitors 119 of the even number column have an opposite capacitor voltage to each other, and the data signals of the an odd number column and an even number column have an opposite polarity to each other, thereby performing inversion for each data line (column inversion).

<4: Summary of Liquid Crystal Display Device>

In this regard, in the above-described embodiment, four-bit gray scale data, Data is used to perform 16 gray scale display. However, the present invention is not limited to this embodiment. For example, the number of bits can be increased to perform multiple gray levels, or one dot is formed of three pixels, R(red), G(green), and B(blue) to perform color display. Also, in the present embodiment, a description is provided based on the normally white mode in which the maximum transmission factor appears when no voltage is applied to the liquid crystal capacitor, however, it may be based on the normally black mode in which the minimum transmission factor appears when no voltage is applied to the liquid crystal capacitor.

Furthermore, in the present embodiment, a glass substrate is used for the element substrate 101. However, the element substrate 101 can be made by applying SOI (Silicon On Insulator) technology to form a silicon monocrystal film on an insulated substrate made of materials, such as sapphire, quartz, and glass, and to create various elements there. Also, for the element substrate 101, a silicon substrate can be used, and various elements can be created there. When a silicon substrate is used in this way, for a switching element, high-speed field effect transistors can be used, thereby making it easy to achieve higher operations than TFT. However, when the element substrate 101 does not have transparency, it is necessary to use a reflection type by forming the pixel electrode 118 using aluminum, or forming a separate reflection layer.

Also, in the present embodiment, as a switching element inserted between the data line 114 and the pixel electrode 118, a three-terminal element, such as TFT, is used. However, a two-terminal element, such as TFD (Thin Film Diode), can also be used.

Further, in the above-described embodiment, TN liquid crystal is used. However, bistable liquid crystal having memorization, such as BTN (Bi-stable Twisted Nematic) type and ferroelectric type, and polymer dispersed type, and the GH (guest-host) type liquid crystal in which dye molecules and crystal molecules are arranged in parallel by dissolving the dye (guest) having anisotropy in absorption of visible light in the molecular longitudinal direction and latitudinal direction into the liquid crystal (host) whose molecules are aligned constantly.

Also, the liquid crystal can be arranged by perpendicular alignment (homoetropic alignment) in which liquid crystal molecules are aligned perpendicularly to the substrates when no voltage is applied, whereas liquid crystal molecules are aligned horizontally to the substrates when voltage is applied, or it can be arranged by (horizontal) alignment (homogeneous alignment) in which liquid crystal molecules are aligned horizontally to the substrates when no voltage is applied, whereas liquid crystal molecules are aligned perpendicularly to the substrates when voltage is applied. In this way, in the present invention, various types of liquid crystal and alignment method can be applied.

<5: Electronic Devices>

Next, some of the electronic devices to which the liquid crystal display device according to the above-described embodiment is applied will be described.

<5-1: Projector>

Figure 14:
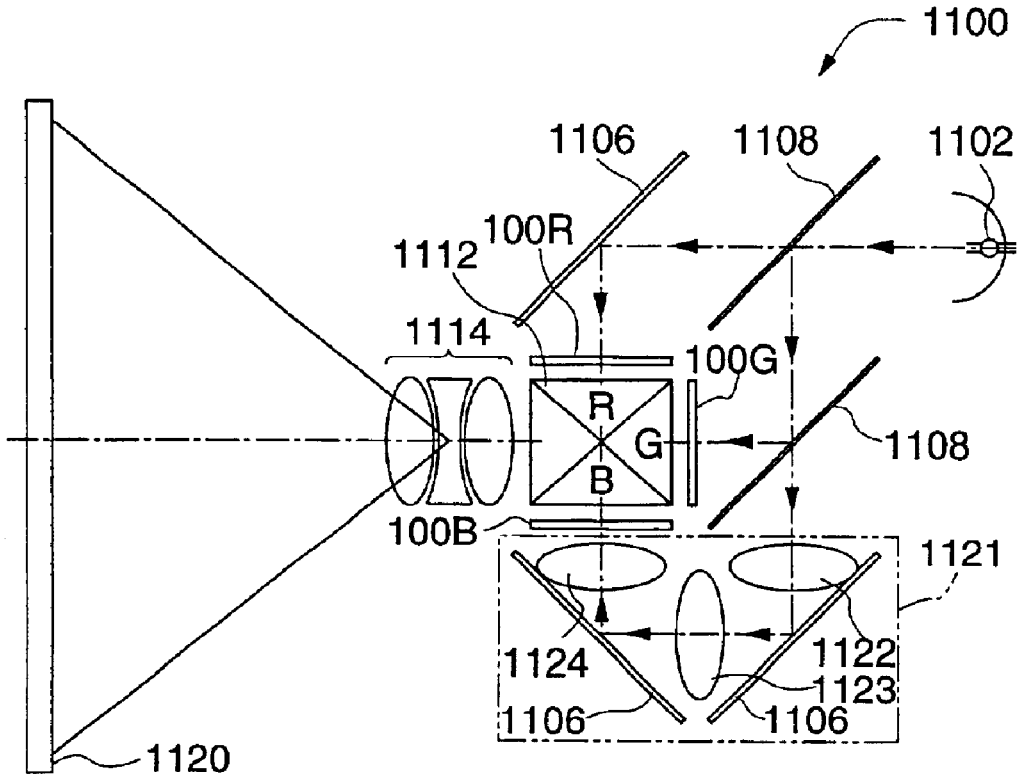
FIG. 14 is a plan view showing the structure of a projector, which is an example of an electronic device to which the liquid crystal display device according to the present embodiment is applied.

First, a projector using the above-described liquid crystal display device 100 as a light valve will be described. FIG. 14 is a plan view showing the structure of the projector.

As shown in FIG. 14, within the projector 1100, a lamp unit 1102 is equipped with a white light source such as a halogen lamp. The projection light emitted from the lamp unit 1102 is separated into three primary colors, R (red), G (Green), and B (Blue), by three mirrors 1106 and two dichroic mirrors disposed inside the projector, and guided to light valves 100R, 100G, and 100B, each of which corresponds to each primary color.

Here, the light valves 100R, 100G, and 100B are basically the same as the liquid crystal display device 100 according to the above-described embodiment. Specifically, the light valves 100R, 100G, and 100B work as a light modulator that generates individual RGB primary color images, respectively.

Furthermore, since the B light has a longer light path compared with the other light, R and G, the light is guided through a relay lens system 1121 which includes an incident lens 1122, a relay lens 1123, and an exit lens 1124 so as to prevent loss.

Now, each light modulated by one of the light valves 100R, 100G, and 100B enters into the dichroic prism 1112 from three directions. Each of the R and B light is deflected 90 degrees via the dichroic prism 1112, while the G light travels straight through. As a result, a color image composed of each primary color image is projected onto a screen 1120 via a projection lens 1114.

In this regard, a dichroic mirror 108 makes the light corresponding to each primary color RGB incident on the light valves 100R, 100G, and 100B, thereby making it unnecessary to arrange color filters as in the case of the direct viewing type panel.

<5-2: Personal Computer>

Figure 15:
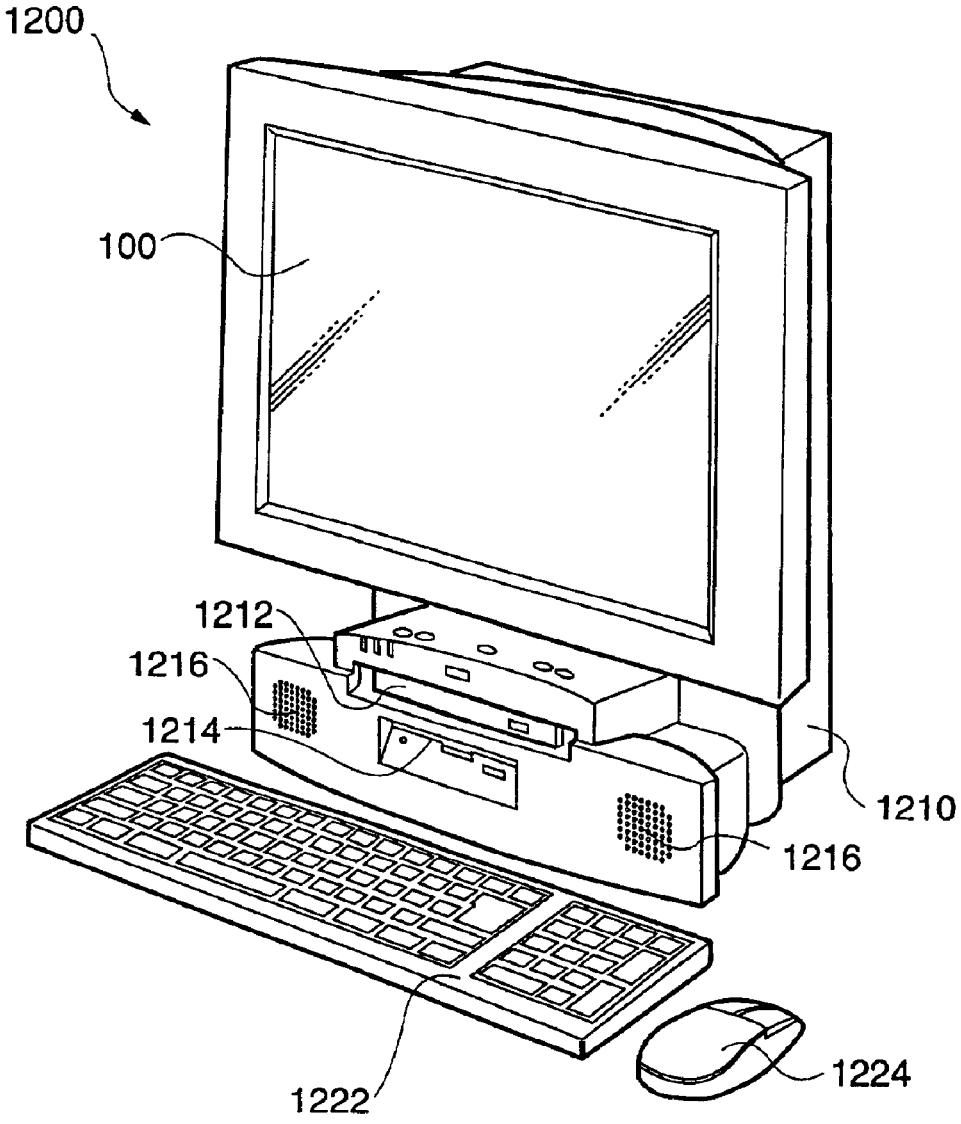
FIG. 15 is a perspective view showing the structure of a personal computer, which is an example of an electronic device to which the liquid crystal display device according to the present embodiment is applied.

Next, an example in which the above-described liquid crystal display device 100 is applied to a multimedia-enabled personal computer will be described. FIG. 15 is a perspective view showing the configuration of the personal computer.

As shown in FIG. 15, a main unit 1210 of a computer 1200 is equipped with a liquid crystal display device 100 used as a display unit, an optical disk read/write drive 1212, a magnetic disk read/write drive 1214, and stereo speakers 1216. Also, the system is configured such that a keyboard 1222 and pointing device (mouse) 1224 send and receive input/control signals to and from the main unit 1210 by wireless, such as via infrared rays.

This liquid crystal display device 100 is used as a direct viewing type. Thus, one dot is formed of three pixels, RGB, and a color filter is arranged corresponding to each pixel.

Also, at the back of liquid crystal display device 100, a backlight unit (not shown in FIG. 15) is provided in order to ensure visibility in dark places.

<5-3: Mobile Phone>

Figure 16:
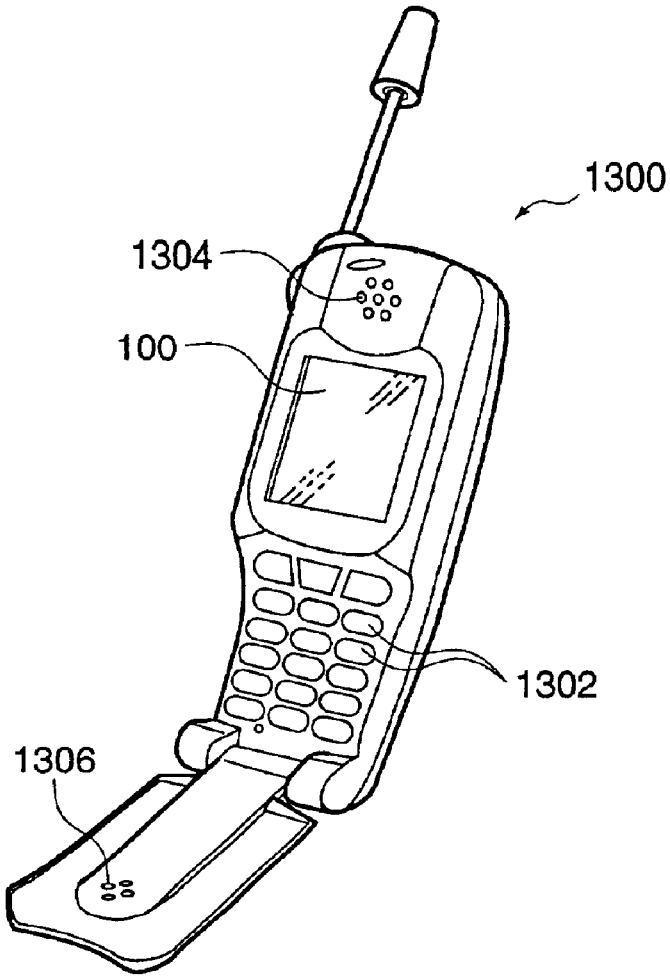
FIG. 16 is a perspective view showing the structure of a mobile phone, which is an example of an electronic device to which the liquid crystal display device according to the present embodiment is applied.

Furthermore, an example in which the above-described liquid crystal display device 100 is applied to a display unit of a mobile phone will be described. FIG. 16 is a perspective view showing the structure of the mobile phone. In FIG. 16, a mobile phone 1300 includes a plurality of operator buttons 1302, a receiver 1304, a mouthpiece 1306, and the above-described liquid crystal display device 100. In this regard, on the back of the liquid crystal display device 100, a backlight unit (not shown) is arranged so as to ensure visibility in the dark, similarly to the above-described personal computer.

<5-4: Summary of Electronic Devices>

In this regard, other electronic devices, in addition to the devices described with reference to FIGS. 14, 15, and 16, can be used with the invention, including but not limited to: liquid crystal TVs, view finder-type/monitor-directly-view-type video tape recorders, car navigation systems, pagers, electronic diaries, calculators, word processors, workstations, TV telephones, POS terminals, digital still cameras, devices with touch panels, and other current and later developed electronic devices. The liquid crystal display device according to the above embodiments, and its variations and modifications, can be applied to these various electronic devices.

As described above, the present invention can reduce the voltage swing of the voltage signal applied to a data line in comparison with the voltage swing applied to a pixel electrode, thus allowing power consumption to be reduced.

What is claimed is:

1. A liquid crystal display device, comprising:

a scanning line which becomes an on-voltage at every predetermined interval;

a liquid crystal capacitor having a liquid crystal sandwiched between a counter electrode and a pixel electrode, the counter electrode being of a reference voltage that is unmodulated;

a data line which becomes a voltage corresponding to a density on the basis of the reference voltage of said counter electrode and to a writing polarity of said liquid crystal capacitor when said scanning line is the on-voltage;

a first switching element inserted between said data line and said pixel electrode, said first switching element being turned on when the on-voltage is applied to said scanning line, and being turned off when an off-voltage is applied;

a storage capacitor having one terminal connected to said pixel electrode and other terminal; and a selector which, when the voltage of said data line corresponds to a positive-polarity writing during the period when the other terminal is the on-voltage, shifts the voltage of the other terminal to high after said scanning line turns off, and when the voltage of said data line corresponds to a negative-polarity writing during the period when the other terminal is the on-voltage, shifts the voltage of the other terminal to low after said scanning line turns off.

2. The liquid crystal display device according to claim 1, the ratio of the capacitance of said storage capacitor to said liquid crystal capacitor being at least 4.

3. The liquid crystal display device according to claim 1, the other terminal of said storage capacitor being connected to each row in common via a capacitor line.

4. The liquid crystal display device according to claim 3, the capacitor line being divided, and the voltage shift directions of the divided capacitor lines being contrary to each other.

5. A liquid crystal display device, comprising:

a scanning line which becomes an on-voltage at every predetermined interval;

a liquid crystal capacitor having a liquid crystal sandwiched between a counter electrode and a pixel electrode;

a data line which becomes a voltage corresponding to a density on the basis of the voltage of said counter electrode and to a writing polarity of said liquid crystal capacitor when said scanning line is the on-voltage;

a first switching element inserted between said data line and said pixel electrode, said first switching element being turned on when the on-voltage is applied to said scanning line, and being turned off when an off-voltage is applied;

a storage capacitor having one terminal connected to said pixel electrode and other terminal, such that, when the voltage of said data line corresponds to a positive-polarity writing during the period when the other terminal is the on-voltage, the voltage of the other terminal is shifted to high after said scanning line turns off, and when the voltage of said data line corresponds to a negative-polarity writing during the period when the other terminal is the on-voltage, the voltage of the other terminal is shifted to low after said scanning line turns off;

a low-level capacitor line which is maintained at a predetermined first voltage;

a high-level capacitor line which is maintained at a second voltage that is higher than said first voltage; and a selector which selects either one of said low-level capacitor line and said high-level capacitor line depending on the voltage of a selection signal line, and applies the voltage to the other terminal of said storage capacitor.

6. The liquid crystal display device according to claim 5, said selector including:

a second switching element inserted between one of said low-level capacitor line and said high-level capacitor line, and the other terminal of said storage capacitor, and the second switching element turns on when the voltage of said selection signal line is one of the high-level voltage and low-level voltage; and a third switching element inserted between the other one of said low-level capacitor line and said high-level capacitor line, and the other terminal of said storage capacitor, and the third switching element turns on when the voltage of said selection signal line is the other one of the high-level voltage and low-level voltage.

7. The liquid crystal display device according to claim 5, said selector having an opposite selection characteristic to the selection characteristic of an adjacent selector in the extending direction of said scanning line.

8. The liquid crystal display device according to claim 5, said selector having an opposite selection characteristic to the selection characteristic of an adjacent selector in the extending direction of said scanning line, and also having an opposite selection characteristic to the selection characteristic of an adjacent selector in the extending direction of said data line.

9. An electronic device, comprising:

the liquid crystal display device according to claim 1.

10. A driving circuit for a liquid crystal display device, the liquid crystal display device including: a liquid crystal capacitor arranged at the intersection of a scanning line and a data line, and having a liquid crystal sandwiched between a counter electrode and pixel electrode, the counter electrode being of a reference voltage that is unmodulated; a first switching element inserted between said data line and said pixel electrode, said first switching element being turned on when the on-voltage is applied to said scanning line, and being turned off when an off-voltage is applied; and a capacitor of which one terminal is connected to said pixel electrode, the driving circuit comprising:

a scanning line driving circuit which turns said scanning line an on-voltage at every predetermined interval;

a data line driving circuit which turns the voltage of said data line to a voltage corresponding to a density on the basis of the reference voltage of said counter electrode and to a writing polarity of said liquid crystal capacitor when said scanning line is on-voltage; and a storage capacitor driving circuit, such that, when the voltage of said data line corresponds to a positive-polarity writing during the period when said scanning line is the on-voltage, the voltage of the other terminal of said storage capacitor is shifted to high after said scanning line turns off, and when the voltage of said data line corresponds to a negative-polarity writing during the period when said scanning line is on-voltage, the voltage of the other terminal of said storage capacitor is shifted to low after said scanning line turns off the storage capacitor driving circuit including:

a low-level capacitor line which is maintained at a predetermined first voltage;

a high-level capacitor line which is maintained at a second voltage that is higher than said first voltage; and a selector which selects either one of said low-level capacitor line and said high-level capacitor line depending on the voltage of a selection signal line, and applies the voltage to the other terminal of said storage capacitor.

11. A driving method for a liquid crystal display device, the liquid crystal display device including: a liquid crystal capacitor arranged at the intersection of a scanning line and a data line, and having a liquid crystal sandwiched between a counter electrode and pixel electrode, the counter electrode being of a reference voltage that is unmodulated; a first switching element inserted between said data line and said pixel electrode, said first switching element being turned on when the on-voltage is applied to said scanning line, and being turned off when an off-voltage is applied; and a capacitor having one terminal connected to said pixel electrode and other terminal, the driving method comprising:

turning a scanning line an on-voltage at every predetermined interval;

turning a voltage of said data line to a voltage difference corresponding to a density on the basis of the reference voltage of said counter electrode and to a writing polarity of said liquid crystal capacitor when said scanning line is the on-voltage;

shifting the voltage of the other terminal of said storage capacitor to high after said scanning line turns off when said data line corresponds to a positive-polarity writing during the period when said scanning line is the on-voltage, the high voltage being maintained by a high-level capacitor line; and shifting the voltage of the other terminal of said storage capacitor to low after said scanning line turns off when said data line corresponds to a negative-polarity writing during the period when said scanning line is the on-voltage, the low voltage being maintained by a low-level capacitor line, either one of said low-level capacitor line and said high-level capacitor line being selected depending on the voltage of a selection signal line, and either one of the high or the low voltage being applied to the other terminal of said storage capacitor.

* * * * *